US006040127A

United States Patent [19]

Kuramitsu et al.

[11] Patent Number: 6,040,127

[45] Date of Patent: Mar. 21, 2000

[54] METHOD FOR PRODUCING SILVER HALIDE EMULSION AND PHOTOGRAPHIC MATERIAL CONTAINING THE SAME

[75] Inventors: Masayuki Kuramitsu; Mitsuo Saitou; Yutaka Maeno; Takefumi Hara, all of Minami Ashigara, Japan

[73] Assignee: Fuji Photo Film Co., Ltd., Kanagawa, Japan

[21] Appl. No.: 08/777,624

[22] Filed: Dec. 31, 1996

[30] Foreign Application Priority Data

Jan. 10, 1996 [JP] Japan ..... 8-002080
Jan. 12, 1996 [JP] Japan ..... 8-003567

[51] Int. Cl.[7] ..... G03C 1/015; G03C 1/035; G03C 1/047

[52] U.S. Cl. ..... 430/567; 430/569; 430/642

[58] Field of Search ..... 430/642, 567, 430/569

[56] References Cited

U.S. PATENT DOCUMENTS 4,301,241 11/1981 Saito et al. ..... 430/569
5,147,773 9/1992 Tsaur et al. ..... 430/569
5,472,837 12/1995 Okutsu ..... 430/569
5,587,281 12/1996 Saitou et al. ..... 430/567

FOREIGN PATENT DOCUMENTS 2-838 1/1990 Japan ..... G03C 1/035
1520976 6/1976 United Kingdom ..... G03C 1/02

*Primary Examiner*—Mark F. Huff
*Attorney, Agent, or Firm*—Birch, Stewart, Kolasch & Birch, LLP

[57] ABSTRACT

A method for producing a silver halide emulsion in which grains having an aspect ratio of from 1.5 to 100 occupy from 75 to 100% of the total projected area of all grains comprising at least nucleation, ripening and grain growth processes in a dispersion medium solution containing water and a dispersion medium, wherein the dispersion medium solution contains low molecular weight gelatin having a molecular weight of from 1,000 to 70,000 at least during a nucleation process and chemically modified gelatin having a chemical modification rate of the amino group of from 15% to 100% at least during a grain growth process.

18 Claims, No Drawings

METHOD FOR PRODUCING SILVER HALIDE EMULSION AND PHOTOGRAPHIC MATERIAL CONTAINING THE SAME

FIELD OF THE INVENTION

The present invention relates to a method for producing a silver halide emulsion and a silver halide photographic material containing the same.

BACKGROUND OF THE INVENTION

It has been known that when an AgX emulsion which contains tabular grains having a large aspect ratio (diameter/thickness) is coated on a support and used as a photographic material, in particular, when the tabular grain emulsion is used in an upper layer, scattering of light to a lower layer is reduced and the sharpness can be improved. Further, it has been known that a large amount of spectral sensitizing dyes can be adsorbed because the tabular grains have a larger surface/volume ratio, and a light absorption factor and a sensitivity granularity ratio are improved. Accordingly, the tabular grains have conventionally been used in various photographic materials. However, there is a harmful effect such that when the tabular grains are produced by conventional methods, the higher the aspect ratio, the higher becomes the degree of polydispersion, therefore, an optimal chemical sensitization cannot be carried out.

Various technical examinations have been made with a view to improving this drawback. For example, techniques for monodispersion of tabular grains are disclosed in JP-A-52-153428 (the term "JP-A" as used herein means an "unexamined published Japanese patent application"), JP-A-55-142329 and JP-A-61-112142, but these techniques are insufficient in the effect of monodispersion.

Moreover, there are disclosed in JP-A-63-151618, JP-A-1-158426 and JP-A-2-838 that monodisperse tabular emulsions can be obtained by using low molecular weight gelatin at the time of nucleus generation.

In addition, methods for producing monodisperse tabular grains in the presence of a polyalkylene oxide block copolymer at the time of nucleation are disclosed in U.S. Pat. Nos. 5,147,771, 5,171,659, 5,147,772 and 5,147,773. A monodisperse tabular grain emulsion having a variation coefficient of 10% or less is disclosed in EP-A-514742. However, the above polyalkylene oxide block copolymers are used in the execution of the working examples of this patent.

It was confirmed that monodisperse tabular grains could certainly be produced by the techniques as disclosed in the above patents, but the monodispersibilities of these grain size distributions were not sufficient, in particular, the graininess was not satisfactory.

Further, when the halide composition of a silver halide emulsion is not uniform, for example, silver iodobromide or silver chloroiodobromide is used, even if the shape of the grains is monodisperse tabular grains as above, that alone will not necessarily be sufficiently effective to increase high contrast of gradation and to reduce unevenness of chemical sensitization among grains as expected above and further improvements of gradation, development progressing capability, pressure capability and preservability have been desired.

SUMMARY OF THE INVENTION

One object of the present invention is to provide a silver halide emulsion which is excellent in sensitivity, graininess and sharpness.

Another object of the present invention is to provide an emulsion which is high contrast in gradation, excellent in development progressing capability, pressure capability and preservability.

The above objects of the present invention have been achieved by the following means, that is:

(1) A method for producing a silver halide emulsion in which grains having an aspect ratio of from 1.5 to 100 occupy from 75 to 100% of the total projected area of all grains comprising at least nucleation, ripening and grain growth processes in a dispersion medium solution containing water and a dispersion medium, wherein the dispersion medium solution contains low molecular weight gelatin having a molecular weight of from 1,000 to 70,000 at least during a nucleation process and chemically modified gelatin having a chemical modification rate of the amino group of from 15% to 100% at least during a grain growth process.

(2) The method for producing a silver halide emulsion as described in (1), wherein the low molecular weight gelatin contained in the dispersion medium is chemically modified gelatin having a modification rate of an amino group of from 15% to 100%.

(3) The method for producing a silver halide emulsion as described in (1), wherein silver halide grains have 10 or more dislocation lines per one grain in the proportion of 50% or more of the number of all the grains in the emulsion.

(4) The method for producing a silver halide emulsion as described in (1), wherein tabular grains having an aspect ratio of from 2 to 50 occupy 75% or more of the total projected area of all the grains in the emulsion.

(5) The method for producing a silver halide emulsion as described in (1), wherein a variation coefficient of the grain size distribution of all the grains in the emulsion is 20% or less.

(6) The method for producing a silver halide emulsion as described in (5), wherein a variation coefficient of distribution among grains of the silver iodide content of all the grains in the emulsion is 30% or less.

(7) A photographic material which contains the silver halide emulsion prepared by the method as described in any one of (1) to (6).

(8) A silver halide emulsion which contains at least a dispersion medium and silver halide grains, wherein tabular grains having an aspect ratio of from 2 to 50 occupy 75% or more of the total projected area of all the grains, a variation coefficient of the grain size distribution of all the grains is 30% or less, silver halide grains have 10 or more dislocation lines per one grain in the proportion of 50% or more of the number of all the grains, and from 30 to 100 wt % of the dispersion medium are chemically modified gelatin having a chemical modification rate of the amino group of from 15% to 100%.

DETAILED DESCRIPTION OF THE INVENTION

The present invention will be described in detail below.

First of all, chemically modified gelatin for use in the present invention is explained.

As the —$NH_2$ group in gelatin, in addition to the amino group of the terminal group of a gelatin molecule, the amino group of a lysine group, a hydroxylysine group, a histidine group, or an arginine group, if an arginine group is converted to an ornithine group, the amino group thereof can be cited. Further, an impurity group such as an adenine group and a guanine group can also be cited. Chemical modification of the —$NH_2$ group-means adding a reaction reagent to gelatin and causing reaction with the amino group to form a covalent bond or deaminate. That is, chemical modification means converting a primary amino group (—$NH_2$) to a secondary amino group (—NH—), a tertiary amino group or a deaminated product.

Chemical modification can be accomplished by adding the following compound as a reagent to gelatin and causing the reaction with the amino group, specifically, for example, acid anhydride (e.g., maleic anhydride, o-phthalic anhydride, succinic anhydride, isatoic anhydride, benzoic anhydride), acid halide (e.g., R—COX, R—$SO_2$X, R—O—COX, phenyl—COCl), a compound having an aldehyde group (e.g., R—CHO), a compound having an epoxy group, a deaminating agent (e.g., $HNO_2$, deaminase), an active ester compound (e.g., sulfonate, p-nitrophenyl acetate, isopropenyl acetate, methyl o-chloro-benzoate, p-nitrophenylbenzoate), an isocyanate compound (e.g., aryl isocyanate), an active halide compound [e.g., aryl halide (benzyl bromide, biphenyl halomethanes, benzoyl halomethane, phenylbenzoyl halomethane, 1-fluoro-2,4-dinitrobenzene), β-ketohalide, α-haloaliphatic acid, β-halonitrile, or chloro derivatives of s-triazine, pyrimidine, pyridazine, pyrazine, pyridazone, quinoxaline, quinazoline, phthalazine, benzoxazole, benzothiazole, and benzimidazole], a carbamoylating agent (e.g., cyanate, nitrourea), a compound having an acryl type active double bond group (e.g., maleimide, acrylamine, acrylamide, acrylonitrile, methyl methacrylate, vinyl sulfone, vinylsulfonate ester, sulfonamide, styrene, vinylpyridine, allylamine, butadiene, isoprene, chloroprene), sultones (e.g., butane sultone, propane sultone), a guanidinating agent (e.g., o-methylisourea), or carboxylazide.

In this case, reagents which react primarily with the —$NH_2$ group in gelatin are preferred to reagents which also react with —OH group and —COOH group in gelatin and form a covalent bond. "Primarily" herein used means 60% or more, preferably from 80 to 100%, and more preferably from 95 to 100%. Further, the reaction product more preferably does not substantially contain a group in which the oxygen of the ether group and the ketone group is substituted with a chalcogen atom, e.g., —S— and a thione group. "Does not substantially contain" means preferably 10% or less, more preferably from 0 to 3%, of the number of the chemically modified groups. Accordingly, of the above-described reagents, acid anhydride, sultones, a compound having an active double bond group, a carbamoylating agent, an active halide compound, an isocyanate compound, an active ester compound, a compound having an aldehyde group, and a deaminating agent are more preferably used. The mode in which crosslinking cannot substantially be done among gelatin molecules by the chemical modification is preferred. Herein, "cannot substantially be done" means preferably 10% or less, more preferably from 0 to 3%, of the chemically modified groups.

With respect to the details of the chemical modifying agents, the methods of chemical modification of gelatin and others, the following patents and publications can be referred to: JP-A-4-226449, JP-A-50-3329, U.S. Pat. Nos. 2,525,753, 2,614,928, 2,614,929, 2,763,639, 2,594,293, 3,132,945, Yoshihiro Abiko, *Nikawa to Gelatin* (*Glue and Gelatin*, Chapter II, Nihon Nikawa•Gelatin Kogyo Kumiai (1987), and Ward, et al., *The Science and Technology of Gelatin*, Chapter 7, Academic Press (1977).

The chemically modified gelatin according to the present invention has chemical modification percentage of the amino group of 15% or more, preferably 50% or more, more preferably 70% or more, and particularly preferably 90% or more.

The content of methionine of the chemically modified gelatin for use in the present invention is not particularly limited but is preferably 30 μmol/g or more, more preferably 35 μmol/g or more.

Chemical modification percentage of the —$NH_2$ group of the chemically modified gelatin can be obtained as follows. Gelatin which is not modified and gelatin which is modified are prepared and the numbers of —$NH_2$ groups of both gelatins are searched for as $e_1$ and $e_2$, respectively. Chemical modification percentage can be obtained by the equation: $100\times(e_1-e_2)/e_1$. $e_1$ and $e_2$ can be obtained from the absorption strength of infrared light based on —$NH_2$ groups, the strength of NMR signals of the protons, or methods by making use of a color reaction and a fluorescent reaction, and details are described in *Bunseki Kagaku Binran, Yuki Hen*-2 (*Analytical Chemistry Handbook, Organic Chemistry*-2), Maruzen (1991). In addition, quantitative methods such as the change of a titration curve of gelatin and a formol titration method can be cited, and *The Science and Technology of Gelatin*, Chapter 15, Academic Press (1977) can be referred to.

The content of methionine of the gelatin can be obtained by finding the amount of methionine based on the amount of glycine by thoroughly decomposing the gelatin to amino acid by alkali hydrolysis and analyzing with an amino acid analyzer. Details thereof are disclosed in JP-A-7-311428.

The molecular weight of the low molecular weight gelatin for use in the present invention is from 1,000 to 70,000, preferably from 3,000 to 40,000. When the molecular weight is 70,000 or more or 1,000 or less, the effect of the present invention cannot be exhibited.

Alkali-processed gelatin is usually used but low molecular weight gelatin of chemically modified gelatin is preferably used. Oxidation-processed gelatin can also be used.

A method for producing a silver halide emulsion according to the present invention is described below.

The nucleation of the silver halide emulsion of the present invention is preferably conducted in low molecular weight gelatin as a dispersion medium under the condition of pBr of preferably from 1.0 to 3.0, more preferably from 1.5 to 2.5.

It is preferred that 35% by weight or more, preferably 50% by weight or more, and more preferably 70% by weight or more, of the dispersion medium be low molecular weight gelatin.

The temperature at nucleation time is preferably 60° C. or less, more preferably from 10 to 50° C. The concentration of the dispersion medium is preferably from 0.01 to 5% by weight, more preferably from 0.01 to 1% by weight, and still more preferably from 0.03 to 0.6% by weight. The concentration of $X^-$ salt is preferably from $10^{-0.8}$ to $10^{-3}$ mol/liter, more preferably from $10^{-1.2}$ to $10^{-2.7}$ mol/liter, and still more preferably from $10^{-1.6}$ to $10^{-2.7}$ mol/liter. The $Ag^+$ solution and/or $X^-$ solution to be added preferably contain(s) a dispersion medium, and the concentration thereof is preferably from 0.01 to 1% by weight, more preferably from 0.03 to 0.6% by weight. The pH of the reaction solution is preferably from 1 to 11 and more preferably from 2 to 6.

It is more preferred that either or both of the aqueous solution of $AgNO_3$ and the aqueous solution of alkali halide to be added at the time of nucleation contain gelatin.

It is preferred that 30% or more, preferably from 60 to 100%, more preferably from 80 to 100%, of the amount of the silver salt added at the time of nucleation be added simultaneously with the $X^-$ salt solution.

The ripening process of the silver halide emulsion of the present invention is described below.

In the ripening process, preferably from 75 to 100%, more preferably from 90 to 100%, and still more preferably 100%, in terms of the number of non-tabular grain nuclei among the nuclei formed in the nucleation process are diminished to increase the ratio of the projected area of tabular grains. Specifically, ripening is conducted with the solubility of the reaction solution increasing to 1.1 times or more, preferably from 1.5 to 30 times. The following methods can be cited as the methods of increasing the solubility: (1) a method of increasing the temperature of the reaction solution by 5° C. or more, preferably by 10 to 60° C., (2) a method of adding $X^-$ salt or silver salt, (3) a method of adding an AgX solvent, and (4) a method of using two or more of the above-described (1) to (3) in combination. The lower the concentration of the dispersing medium at the time of ripening and the lower the pH, the more rapid is the progress of the ripening. This is presumably because the adsorbing strength of the dispersion medium onto AgX grains becomes weak and the growth inhibiting factors of tabular grains are excluded, and the solution of non-tabular grains is accelerated. With respect to the concentration of the dispersion medium during ripening, the molecular weight of the dispersion medium, the pH of the reaction solution, and the kinds of the dispersion medium, the above description concerning the nucleation conditions can be referred to. The concentration of $X^-$ salt is preferably from $10^{-0.8}$ to $10^{-2.5}$ mol/liter, more preferably from $10^{-1.2}$ to $10^{-2}$ mol/liter.

The growth conditions of the silver halide emulsion according to the present invention are described below.

In the present invention, from 30 to 100% by weight, preferably from 60 to 100% by weight, more preferably from 75 to 100% by weight, and most preferably from 80 to 100% by weight, of the dispersion medium in the dispersion medium solution in the grain growth process are chemically modified gelatin in which 15% or more of the amino groups are chemically modified. Chemically modified gelatin for use in the present invention may be present through the entire process of grain formation but is preferably added after the termination of the nucleation process, more preferably added after the termination of the ripening process.

The temperature of the growth process is preferably 30° C. or more, more preferably from 40 to 90° C. The most preferred temperature can be selectively used.

The pH of the growth process is from 6 to 11, preferably from 6 to 10 for the best effect.

Tabular grains are preferably grown by selecting the most preferred supersaturation degree according to the purpose. When taking the critical supersaturation degree as 100 and the supersaturation degree when the solute is not added as 0, the supersaturation degree is preferably from 5 to 90, more preferably from 10 to 80. Here, the critical supersaturation degree, means, when an aqueous solution of $AgNO_3$ and an aqueous solution of $X^-$ salt are added at the same time, such a supersaturation degree of the state as a new nucleus is generated, if the addition rate is further increased. When the supersaturation degree is heightened, tabular grains obtained become more monodisperse but they also grow in the thickness direction and the aspect ratio becomes low, while when the supersaturation degree is lowered, the aspect ratio becomes high but the size distribution is broadened.

The concentration of the dispersion medium during the growth process is preferably from 0.1 to 7% by weight, more preferably from 0.3 to 3% by weight. The molecular weight is from 3,000 to 200,000, preferably from 6,000 to 120,000. The pH of the solution is preferably the isoelectric point or more of the chemically modified gelatin, more preferably from (the isoelectric point +0.2) to 11, still more preferably from (the isoelectric point +0.4) to 10. When tabular grains are grown under the same condition, the lower the pH and the lower the concentration of gelatin and the lower the molecular weight, the higher is the aspect ratio of the tabular grains formed. The most preferred combination can be selected according to the purpose.

With respect to other details of the silver halide grains according to the present invention, the disclosures in the patents described in the above "Background of the Invention" of the present specification and JP-A-3-288143, JP-A-3-212639, JP-A-3-116133, JP-A-2-301742, JP-A-2-34, JP-A-6-59360, JP-A-7-234470, JP-A-7-104405, JP-A-7-146522 and JP-A-6-308648 can be referred to.

The polyalkylene oxide block copolymers disclosed in U.S. Pat. Nos. 5,147,771, 5,171,659, 5,147,772, 5,147,773 and EP-A-514742 can preferably be used in combination with gelatin for use in the present invention.

The tabular grain according to the present invention has two substantially parallel faces and the thickness of the grain is the distance between the above two parallel faces. The diameter of the grain is represented by the diameter of the circle having the equal area to the projected area of the grain. The aspect ratio of the grain is the diameter/thickness ratio of the grain. The aspect ratio of the tabular grain for use in the present invention is from 1.5 to 100, preferably from 2 to 50, more preferably from 4 to 20, and it may be 8 or more.

The silver halide emulsion according to the present invention means the tabular grains having the variation coefficient of 30% or less, preferably 20% or less, more preferably 15% or less, which variation coefficient vc is obtained by dividing the standard deviation S of the diameters of the circles equal to the projected areas of all the grains contained in the emulsion by average grain size r. The above-described grain size can be measured, for example, according to the method disclosed in Mees and James, *The Theory of the Photographic Process*, Chapter 2, 3rd Ed., Macmillan (1966).

The latent image of the light-sensitive emulsion may be primarily formed on the surface, or may be formed within the grains, or the latent image is formed both on the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

A silver halide solvent can be used in the present invention. Silver halide solvents which can be used in the present invention include, for example, (a) the organic thioethers disclosed in U.S. Pat. Nos. 3,271,157, 3,531,289, 3,574,628, JP-A-54-1019 and JP-A-54-158917, (b) the thiourea derivatives disclosed in JP-A-53-82408, JP-A-55-77737 and JP-A-55-2982, (c) the silver halide solvents having the thiocarbonyl group between an oxygen or sulfur atom and a nitrogen atom disclosed in JP-A-53-144319, (d) the imidazoles disclosed in JP-A-54-100717, (e) sulfite, and (f) thiocyanate.

Particularly preferred are thiocyanate and tetramethylthiourea. The amount of the solvent used is varied depending on the kind of the solvent, for example, thiocyanate is preferably used in an amount of from $1\times10^{-4}$ mol to $1\times10^{-2}$ mol per mol of the silver halide.

The silver halide photographic emulsion of the present invention uses sulfur sensitization and/or gold sensitization in combination in chemical sensitization.

Sulfur sensitization is usually carried out by adding a sulfur sensitizer and stirring the emulsion for a predetermined period of time at high temperature, preferably 40° C. or more.

Gold sensitization is usually carried out by adding a gold sensitizer and stirring the emulsion for a predetermined period of time at high temperature, preferably 40° C. or more.

Known sulfur sensitizers can be used for the above sulfur sensitization, for example, thiosulfate, thiourea acid, allyl isothiacyanate, cystine, p-toluenethiosulfonate, and rhodanine. In addition to the above, the sulfur sensitizers disclosed in U.S. Pat. Nos. 1,574,944, 2,410,689, 2,278,947, 2,728,668, 3,501,313, 3,656,955, German Patent 1,422,869, JP-B-56-24937 (the term "JP-B" as used herein means an "examined Japanese patent publication") and JP-A-55-45016 can also be used. The addition amount of sulfur sensitizers should be sufficient to effectively increase the sensitivity of the emulsion. The addition amount varies in a considerably wide range according to various conditions such as the pH, temperature and size of silver halide grains but is preferably from $1\times10^{-7}$ mol to $5\times10^{-4}$ mol per mol of the silver halide.

The oxidation number of the gold sensitizers of the above-described gold sensitization may be monovalent (+1) or trivalent (+3) and gold compounds usually used as gold sensitizers can be used. Representative examples thereof include, for example, chloroaurate, potassium chloroaurate, auric trichloride, potassium auric thiocyanate, potassium iodoaurate, tetracyanoauric acid, ammonium aurothiocyanate, and pyridyl trichloro-gold.

The addition amount of the gold sensitizers varies according to various conditions but is preferably from $1\times10^{-7}$ to $5\times10^{-4}$ mol per mol of the silver halide as a criterion.

When chemical ripening is carried out, the addition time and order of a silver halide solvent and a selenium sensitizer or a sulfur sensitizer and/or a gold sensitizer which can be used in combination with a selenium sensitizer are not particularly limited, for example, these compounds can be added at the same time or differently at early stage of chemical ripening (preferably) or during chemical ripening is progressing. They are dissolved in water, or a single solution or a mixed solution of an organic solvent miscible with water, e.g., methanol, ethanol, acetone, and added.

Chemical sensitization can be conducted in the presence of an auxiliary chemical sensitizer. The compounds known to inhibit fogging during chemical sensitization and to increase sensitivity such as azapyridazine, azapyrimidine, are used as a useful auxiliary chemical sensitizer. Examples of auxiliary chemical sensitizer reformation are disclosed in U.S. Pat. Nos. 2,131,038, 3,411,914, 3,554,757, JP-A-58-126526 and G. F. Duffin, *Photographic Emulsion Chemistry*, pp. 138 to 143. In addition to or in place of chemical sensitization, reduction sensitization can be conducted using, for example, hydrogen as disclosed in U.S. Pat. Nos. 3,891,446 and 3,984,249. Reduction sensitization can be carried out using stannous chloride, thiourea dioxide, polyamine, and the like reducing agents as disclosed in U.S. Pat. Nos. 2,518,698, 2,743,182 and 2,743,183. Further, reduction sensitization can be conducted by high pH process (e.g., greater than 8). Moreover, spectral sensitization property can be improved by the chemical sensitizing methods disclosed in U.S. Pat. Nos. 3,917,485 and 3,966,476.

The emulsion grain according to the present invention is preferably silver iodobromide or silver chloroiodobromide.

The emulsion grain according to the present invention contains at least one phase of silver iodide phase, silver iodobromide phase, silver chloroiodobromide phase and silver chloroiodide phase.

Other silver salt, for example, silver thiocyanate, silver sulfide, silver selenide, silver carbonate, silver phosphate, or organic acid silver may be contained as separate grains or as a part of silver halide grains.

The preferred content of silver iodide of the emulsion grain according to the present invention is from 0.1 to 20 mol %, more preferably from 0.3 to 15 mol %, and particularly preferably from 1 to 10 mol %.

The relative standard deviation of the silver iodide content distribution of the individual grain of the tabular grains according to the present invention is from 20% to 1%, more preferably 10% or less.

The silver iodide content of individual emulsion grain can be measured, for example, by analyzing the composition of the grain one by one with an X-ray microanalyzer. "The relative standard deviation of the silver iodide content distribution of individual grain" means the value obtained by measuring the silver iodide content of at least 100 emulsion grains with an X-ray microanalyzer, dividing the standard deviation of the silver iodide content distribution by the average silver iodide content and multiplying 100. The specific method of measuring the silver iodide content of individual emulsion grain is disclosed, for example, in EP-A-147868.

The smaller the variation coefficient of the silver iodide content distribution of individual grain, the nearer is the optimal point (conditions of the chemical sensitization suitable for individual grain) of the chemical sensitization of individual grain, and it becomes possible to get out the capacities of all emulsion grains. Therefore, the variation coefficient is preferably small.

The constitution concerning the halide composition of grains can be confirmed by various methods in combination, for example, x-ray diffraction, an EPMA method (XMA by another name) (a method of scanning a silver halide grain with an electron beam and detecting the silver halide composition), an ESCA method (XPS by another name) (a method of X-raying a grain and spectral-analyzing the photoelectron coming out from the surface of the grain).

To make the silver iodide content of the grain among grains of an emulsion uniform, it is important to make it uniform the size and the shape after Ostwald ripening as far as possible. Further, in the growth stage, an aqueous solution of silver nitrate and an aqueous solution of alkali halide are added by a double jet method while maintaining the pAg constant within the range of 6.0 to 10.0. For carrying out uniform covering, the supersaturation degree of the solution while adding is preferably high, and the addition is conducted, for example, by such a method as disclosed in U.S. Pat. No. 4,242,445, preferably at a comparatively high super-saturation degree such that the growing speed of the crystal becomes from 30 to 100% of the critical growing speed of the crystal.

Further, when an iodide is added it is effective to select the conditions described below to make the silver iodide content of individual grain uniform. That is, the pAg before addition of the iodide is preferably from 8.5 to 10.5, more preferably from 9.0 to 10.5. The temperature is preferably maintained at 50° C. to 30° C. In addition, iodide ion is preferably added as a silver halide emulsion not by the addition as ion. In this case, in view of solubility, silver halide grains are preferably as fine as possible. The preferred grain size is from 0.1 to 0.001 $\mu$m. Moreover, the preferred halide composition is the case where the silver iodide content is from 20 to 100 mol %, more preferably from 40 to 100 mol %.

Further, the silver iodide distribution among grains can be made uniform by using an iodide ion releasing agent as compared with conventional methods. Iodide ion releasing agents are disclosed, for example, in JP-A-6-138595.

Concerning the number of dislocation lines of the grains according to the present invention, it is preferred that grains having 10 or more dislocation lines per one grain account for 50% or more in terms of the number, more preferably grains having 10 or more dislocation lines account for 80% or more in terms of the number, and particularly preferably grains having 20 or more dislocation lines account for 80% or more in terms of the number, based on the number of all the grains in the emulsion.

Dislocation lines means a linear lattice defect on the boundary of the region already slid and the region not yet slid on the sliding surface of a crystal.

Dislocation lines of silver halide grains can be observed by a direct method with a low temperature transmission type electron microscope as disclosed, for example, in J. F. Hamilton, Photo. Sci. Enq., 11, 57 (1967) and T. Shiozawa, *J. Soc. Photo. Sci. Japan*, 35, 213 (1972). That is, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout). The number and the location of the dislocation lines of each grain can be obtained from the photograph of the grain obtained according to this method.

The dislocation lines of the silver halide grains according to the present invention can be controlled by providing a specific high silver iodide content phase in the interior of the grain. Specifically, a grain as a substrate is prepared, then a high silver iodide content phase is provided on the substrate grain and the outside thereof is covered with a phase having a lower iodide content than that of the high silver iodide content phase. Herein, it is important to appropriately select the above-described forming conditions of high silver iodide content phase to make the silver iodide content of each grain uniform. An internal high silver iodide content phase means a silver halide solid solution containing iodide. In this case, silver iodide, silver iodobromide, or silver chloroiodobromide is preferred as silver halide, but silver iodide or silver iodobromide (a silver iodide content: from 10 to 40 mol %) is more preferred and silver iodide is particularly preferred.

This internal high silver iodide content phase is not such a phase as silver iodide is deposited uniformly on the substrate grain but it is rather important that silver iodide should be present locally. Such localization may occur on any of the plane, edge or corner of the grain. Further, an internal high silver iodide content phase may be coordinated on such a part selectively and epitaxially.

For this purpose, a method of adding iodide alone, i.e., a conversion method, or epitaxial junction methods disclosed in JP-A-59-133540, JP-A-58-108526 and JP-A-59-162540 can be used. At this time, it is effective to select the following conditions to make the silver iodide content of each grain uniform. That is, the pAg at the time of iodide addition is more preferably from 8.5 to 10.5 and particularly preferably from 9.0 to 10.5. The temperature is preferably maintained from 30 to 50° C. The addition of iodide is preferably conducted with sufficiently stirring in an amount of 1 mol % based on the entire silver amount for from 30 seconds to 5 minutes. The silver iodide content of the substrate grain is lower than that of the high silver iodide content phase, preferably from 0 to 12 mol %, more preferably from 0 to 10 mol %. The silver iodide content of the outer phase covering the high silver iodide content phase is lower than that of the high silver iodide content phase, preferably from 0 to 12 mol %, more preferably from 0 to 10 mol %, and most preferably from 0 to 3 mol %.

This internal high silver iodide content phase preferably exists within the range of from 5 to 80 mol %, more preferably from 20 to 70 mol %, and particularly preferably from 30 to 70 mol %, based on the silver amount of the entire grain from the center of the silver halide grain.

The content of the iodide of the internal high silver iodide content phase is higher than the content of the iodide in the silver iodide, silver iodobromide or silver chloroiodobromide existing on the surface of the grain, preferably 5 times or more, particularly preferably 20 times or more.

Further, the amount of the silver halide comprising the internal high silver iodide content phase is 50 mol % or less, more preferably 10 mol % or less, and particularly preferably 5 mol % or less, of the silver amount of the entire grain in terms of silver.

It is preferred that the emulsion grain according to the present invention have the structure based on the halide composition. A grain having one or more shells to a substrate grain, e.g., a grain having a double structure, a triple structure, a quadruple structure, a quintuple structure, . . . a multiple structure are preferred.

A grain having one or more deposited layers which are not completely covered to a substrate grain, e.g., a grain having a double structure, a triple structure, a quadruple structure, a quintuple structure, . . . a multiple structure are also preferred.

Various compounds can be present during precipitation process of silver halide to control the nature of silver halide grains. Such compounds may be present in the reaction vessel from the first, or according to ordinary methods, when 1 or 2 or more salts are added they can be added together. As disclosed in U.S. Pat. Nos. 2,448,060, 2,628,167, 3,737, 313, 3,772,031 and *Research Disclosure*, Vol. 134, June, 1975, No. 13452, by the presence of copper, iridium, lead, bismuth, cadmium, zinc, (a chalcogen compound such as sulfur, selenium and tellurium), gold and a compound such as a noble metal compound of Group VII during precipitation process of silver halide, characteristics of silver halide can be controlled. The interior of the grain of a silver halide emulsion can be reduction sensitized during precipitation process as disclosed in JP-B-58-1410, Moisar et al., *Journal of Photographic Science*, Vol. 25, 1977, pp. 19 to 27.

The silver halide emulsion according to the present invention can be used in combination with the emulsion comprising ordinarily chemically sensitized silver halide grains (hereinafter referred to as non-tabular grains) in the same silver halide emulsion layer. In particular, in the case of a color photographic material, the tabular grain emulsion and the non-tabular grain emulsion can be used respectively in different emulsion layers and/or in the same emulsion layer. Herein, as the non-tabular grains, for example, regular grains having regular crystal form such as a cubic, octahedral or tetradecahedral form, or grains having an irregular crystal form such as a spherical or pebble-like form can be cited. Further, as silver halide of these non-tabular grains, any silver halide such as silver bromide, silver iodobromide, silver iodochlorobromide, silver chlorobromide, and silver chloride can be used. Preferred silver halide is silver iodobromide or silver iodochlorobromide containing 30 mol % or less of silver iodide. Particularly preferred is silver iodobromide containing from 2 mol % to 25 mol % of silver iodide.

Chemical ripening of the emulsion for use in the present invention and additives for use in spectral sensitization are described in *Research Disclosure*, No. 17643 (December, 1978) and ibid., No. 18716 (November, 1979).

Spectral sensitizing dyes, antifoggants and stabilizers can be present at any process of the photographic emulsion producing processes and any stage after production immediately before coating. Examples of the former include, for example, a silver halide grain forming process, a physical ripening process, and a chemical ripening process. That is, spectral sensitizing dyes, antifoggants and stabilizers are also used for purposes of limiting the place of formation of a chemically sensitized speck, stopping excessive halide change and maintaining junction structure of different halides for obtaining grains having junction structure of different halide compositions, by making use of other properties such as strong adsorbing capability to an emulsion, in addition to their original functions. With respect to these, JP-A-55-26589, JP-A-58-111935, JP-A-58-28738, JP-A-62-7040, U.S. Pat. Nos. 3,628,960 and 4,225,666 can be referred to.

When the partial amounts or the entire amounts of a spectral sensitizing dye, an antifoggant and a stabilizer to be added are added before a chemical sensitizer is added, then a chemical sensitizer is-added and chemical ripening is carried out, the place on the silver halide grain where a chemically sensitized speck is formed is limited to the place where the spectral sensitizing dye, the antifoggant and the stabilizer are not adsorbed, which is particularly preferred as the dispersion of latent images can be prevented and photographic properties are improved. In particular, when a sensitizing dye, an antifoggant and a stabilizer which are selectively adsorbed onto {111} faces of a silver halide grain are added, a chemically sensitized speck is limitedly formed on the edge part of the grain in the case where hexagonal tabular grain is used, therefore, preferred.

It is also effective to conduct chemical sensitization under the presence of a silver halide solvent. As such a silver halide solvent, thiocyanate and the solvents disclosed in JP-A-63-151618 can be used. The concentration of the solvent is preferably from $10^{-5}$ to $10^{-1}$ mol/liter.

The removal of soluble silver salt from the emulsion before and after physical ripening is carried out by a noodle washing method, a flocculation precipitation method or an ultrafiltration method.

The emulsion produced according to the present invention can be used with known emulsions other than the emulsion according to the present invention by introducing into the same layer, adjacent layers or other layers. When the emulsion other than the emulsion according to the present invention is used in admixture with the emulsion according to the present invention in the same layer, the mixing ratio can be changed optionally depending on the silver iodide content on the surface or the use purpose.

When two kinds of emulsions are used in admixture, they are preferably used in the ratio by weight of from 3/97 to 97/3.

Moreover, two or more kinds of emulsions produced according to the present invention but different, for example, in halide compositions, distributions of halide in the grains, sizes, size distributions, crystal forms, crystal habits, and latent image distributions can be used in combination in the same layer, adjacent layers or other layers.

The silver halide emulsion according to the present invention is preferably spectrally sensitized.

Methine dyes are generally used as a spectral sensitizing dye in the present invention. Examples thereof include a cyanine dye, a merocyanine dye, a complex cyanine dye, a complex merocyanine dye, a holopolar cyanine dye, a hemicyanine dye, a styryl dye, and a hemioxonol dye. Nuclei which are usually utilized as basic heterocyclic nuclei in cyanine dyes can be applied to these dyes. For example, pyrroline, oxazoline, thiazoline, pyrrole, oxazole, thiazole, selenazole, imidazole, tetrazole, pyridine; the above nuclei to which alicyclic hydrocarbon rings are fused; the above nuclei to which aromatic hydrocarbon rings are fused, that is, indolenine, benzindolenine, indole, benzoxazole, naphthoxazole, benzothiazole, naphthothiazole, benzoselenazole, benzimidazole, and quinoline nucleus can be applied. These heterocyclic nuclei may be substituted on the carbon atoms.

As a nucleus having a ketomethylene structure, a 5- or 6-membered heterocyclic nucleus such as pyrazolin-5-one, thiohydantoin, 2-thiooxazolidine-2,4-dione, thiazolidine-2, 4-dione, rhodanine or thiobarbituric acid can be applied to a merocyanine dye or a complex merocyanine dye.

Of the above dyes, a particularly useful sensitizing dye is a cyanine dye for the present invention.

In addition to the above, spectral sensitizing dyes disclosed in the following patents are used in the present invention: for example, those disclosed in German Patent 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, 4,026,707, British Pat. Nos. 1,242,588, 1,344,281, 1,507,803, JP-B-44-14030, JP-B-52-24844, JP-B-43-4936, JP-B-53-12375, JP-A-52-110618, JP-A-52-109925, and JP-A-50-80827.

In addition, the silver halide emulsion for use in the present invention may be a system as spectrally sensitized with an antenna dye. With respect to spectral sensitization using an antenna dye, JP-A-62-209532, JP-A-63-138341 and JP-A-63-138342 can be referred to.

The amount of sensitizing dyes added during the production of silver halide emulsion cannot be described uniformly according to the kinds of additives and the amount of silver halide, but almost the same amount as added in conventional methods can be used.

That is, the preferred addition amount of sensitizing dyes is from 0.001 to 100 mmol, more preferably from 0.01 to 10 mmol, per mol of the silver halide.

Sensitizing dyes are added after chemical ripening or before chemical ripening. To the silver halide grains according to the present invention, sensitizing dyes are added most preferably during chemical ripening or before chemical ripening (for example, at the time of grain formation or at the time of physical ripening).

Dyes which themselves do not have a spectral sensitizing function or substances which substantially do not absorb visible light but show supersensitization can be incorporated in the emulsion with sensitizing dyes. For example, aminostil compounds substituted with nitrogen-containing heterocyclic nucleus groups (e.g., those disclosed in U.S. Pat. Nos. 2,933,390 and 3,635,721), aromatic organic acid-formaldehyde condensation products (those disclosed in U.S. Pat. No. 3,743,510), cadmium salts or azaindene compounds may be contained in the emulsion. The combinations disclosed in U.S. Pat. Nos. 3,615,613, 3,615,641, 3,617,295 and 3,635,721 are particularly useful.

Various compounds can be added to the photographic emulsion according to the present invention for preventing generation of fog or stabilizing photographic capacities during production, storage or processing of the photographic material. Such compounds include compounds well-known as an antifoggant or a stabilizer such as azoles, e.g., benzothiazolium salt, nitroindazoles, triazoles, benzotriazoles, benzimidazoles (in particular, nitro- or halogen-substituted); heterocyclic mercapto compounds, e.g., mercaptothiazoles, mercaptobenzothiazoles, mercaptobenzimidazoles, mercaptothiazoles, mercaptotetrazoles (in particular, 1-phenyl-5-mercaptotetrazole), mercaptopyrimidines; the above heterocyclic mercapto compounds having a water-soluble group, e.g., a carboxyl group and a sulfone group; thioketo compounds, e.g., oxazolinethione; azaindenes, e.g., tetraazaindenes (in particular, 4-hydroxy-substituted-(1,3,3a,7)tetraazaindenes); benzenethiosulfonic acid; benzenesulfinic acid.

These antifoggant and stabilizer are, in general, added after chemical sensitization but they are more preferably added during chemical ripening or before the start of chemical ripening and the time of addition can be selected optionally. That is, in the silver halide emulsion grain formation process, they may be added at any time during the addition of an aqueous solution of silver salt, during the period after the addition of an aqueous solution of silver salt and before the start of chemical ripening, or during chemical ripening (preferably within 50% of the time of chemical ripening, more preferably within 20% of the chemical ripening time).

Specific examples of these compounds include a hydroxy azaindene compound, a benzotriazole compound, and a heterocyclic compound which is substituted with at least one mercapto group and has at least two aza-nitrogen atoms in the molecule.

The addition amount of these antifoggant and stabilizer for use in the present invention cannot be determined uniformly according to the method of addition and the amount of silver halide, but is preferably from $10^{-7}$ to $10^{-2}$ mol, more preferably from $10^{-5}$ to $10^{-2}$ mol, per mol of the silver halide.

The emulsion according to the present invention can be used in admixture with the emulsion other than the emulsion according to the present invention. Two or more emulsions according to the present invention can be used in admixture, or the emulsion according to the present invention can be used with one, two or more other emulsions. Emulsions having different grain sizes can be mixed, emulsions having different halide compositions can be mixed, or emulsions having different grain shapes-can be mixed. Monodisperse emulsions can be mixed each other, polydisperse emulsions can be mixed each other, or monodisperse emulsion and poly-disperse emulsion can be mixed. The silver halide emulsion according to the present invention is preferably contained at least 50% or more of the entire projected area.

The above-described various additives are used in the photographic material according to the present invention but various other additives can be used according to purposes.

In addition to the above description, various techniques and inorganic and organic materials which can be used in the color photographic material to which the silver halide photographic emulsion of the present invention can be applied are disclosed more in detail, for example, in the following places of EP-A-436938 and the patents cited in the following places.

With respect to the silver halide photographic emulsion according to the present invention, and various techniques and inorganic and organic materials which can be used in the silver halide photographic material using the silver halide photographic emulsion of the present invention, in general, those disclosed in *Research Disclosure*, No. 308119 (1989) can be used.

The emulsion according to the present invention can be used in various photographic materials but it is preferred to be used in a color photographic material. When the emulsion according to the present invention is used in a color photographic material, more specific techniques and inorganic and organic materials are disclosed in the following places of EP-A-436938 and the patents cited in the following places.

| Item | Place |
|---|---|
| 1) Layer Structure | line 34, page 146 to line 25, page 147 |
| 2) Silver Halide Emulsion Which Can Be Used in Combination | line 26, page 147 to line 12, page 148 |
| 3) Yellow Coupler | line 35, page 137 to line 33, page 146, lines 21 to 23, page 149 |
| 4) Magenta Coupler | lines 24 to 28, page 149; line 5, page 3 to line 55, page 25 of EP-A-421453 |
| 5) Cyan Coupler | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |
| 7) Colored Coupler | line 42, page 53 to line 34, page 137, lines 39 to 45, page 149 |
| 8) Other Functional Coupler | line 1, page 7 to line 41, page 53, line 46, page 149 to line 3 page 150; line 1, page 3 to line 50, page 29 of EP-A-435334 |
| 9) Preservative, Antibacterial Agent | lines 25 to 28, page 150 |
| 10) Formalin Scavenger | lines 15 to 17, page 149 |
| 11) Other Additives | lines 38 to 47, page 153; line 21, page 75 to line 56, page 84 of EP-A-421453, line 40, page 27 to line 40, page 37 |
| 12) Dispersion Method | lines 4 to 24, page 150 |
| 13) Support | line 32 to 34, page 150 |
| 14) Film Thickness, Physical Properties of Film | lines 35 to 49, page 150 |
| 15) Color Development Black-and White Development, Fogging Process | line 50, page 150 to line 47, page 151; lines 11 to 54, page 34 of EP-A-442323, lines 14 to 22, page 35 of EP-A-442323 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The silver halide color photographic materials according to the present invention are effective for film units with a lens as disclosed in JP-B-2-32615, JP-B-U-3-39784 (the term "JP-B-U" as used herein means an "examined Japanese utility model publication"), etc.

A transparent magnetic recording layer can be used in the present invention.

A transparent magnetic recording layer for use in the present invention is a layer coated on a support with an aqueous or organic solvent based coating solution comprising magnetic grains dispersed in a binder.

Examples of the magnetic grains for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the grain may be any of acicular shape, a granular shape, a spherical shape, a cubic shape, or a plate-like shape. The specific surface area ($S_{BET}$) is preferably 20 $m^2/g$ or more, and particularly preferably 30 $m^2/g$ or more. The saturation magnetization ($\sigma_s$) of the ferromagnetic substance is preferably from $3.0\times10^{-4}$ to $3.0\times10^5$ A/m and particularly preferably from $4.0\times10^{-4}$ to $2.5\times10^5$ A/m. The ferromagnetic grains may be surface treated with silica and/or alumina and organic materials. Further, the surface of the magnetic grains may be treated with a silane coupling agent or a titanium coupling agent as disclosed in JP-A-6-161032. In addition, the magnetic grains the surfaces of which are covered with inorganic or organic substance as disclosed in JP-A-4-259911 and JP-A-5-81652 can also be used.

The binders which can be used for the magnetic grains includes the thermoplastic resins, thermosetting resins, radiation curable resins, reactive type resins, acid-, alkali- or biodegradable polymers, natural polymers (e.g., cellulose derivatives, sugar derivatives), and mixtures thereof disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in a binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 $\mu$m to 10 $\mu$m, preferably from 0.2 $\mu$m to 5 $\mu$m, and more preferably from 0.3 $\mu$m to 3 $\mu$m. The weight ratio of the magnetic grains to the binder is preferably from 0.5/100 to 60/100, and more preferably from 1/100 to 30/100. The coating amount of the magnetic grains is from 0.005 to 3 $g/m^2$, preferably from 0.01 to 2 $g/m^2$, and more preferably from 0.02 to 0.5 $g/m^2$. A magnetic recording layer for use in the present invention can be provided on the back surface of the photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the grains are preferably abrasives of non-spherical inorganic grains having Mohs' hardness of 5 or more. The composition of the non-spherical inorganic grain is preferably oxide such as aluminum oxide, chromium oxide, silicon dioxide, titanium dioxide, etc., carbide such as silicon carbide and titanium carbide, and fine powders such as diamond. The surface of these abrasives may be treated with a silane coupling agent or a titanium coupling agent. These grains may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and European Patent 466130.

The polyester support-for use in the present invention is described below, but details including photographic materials described later, processing, cartridges and examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalene-dicarboxylic acid, terephthalic acid, isophthalic acid, and phthalic acid, and as diols, diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more and less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be carried out in a web state while transporting. The surface of the support may be provided with concave and convex (e.g., coating conductive inorganic fine grains such as $SnO_2$ or $Sb_2O_5$) to improve the surface state. Also, it is preferred to make some designs such that the edge is knurled to slightly increase the height of only the edge, thereby preventing the difference in level due to the edge from imparting the evenness of support wound thereon. The heat treatment may be carried out at any stage of after formation of the support, after the surface treatment, after coating of a backing layer (an antistatic agent, a sliding agent, etc.), or after undercoating, but preferably conducted after coating of an antistatic agent.

An ultraviolet absorber may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may be two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, $TiO_2$, inorganic fine grains or polymethyl methacrylate copolymer fine grains (0.01 to 10 $\mu$m) may be contained as a matting agent.

Further, antistatic agents are preferably used in the present invention. Examples of such antistatic agents include high polymers containing carboxylic acid and carboxylate, sulfonate, cationic polymer, and ionic surfactant compounds.

The most preferred antistatic agents are fine grains of a crystalline metal oxide of at least one grain selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7\Omega\cdot$cm or less, more preferably $10^5\Omega\cdot$m or less and having a grain size of from 0.001 to 1.0 $\mu$m or fine grains of composite oxides of them (Sb, P, B, In, S, Si, C), further, fine grains of a metal oxide in the form of sol or fine grains of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material according to the present invention to contain a sliding agent. The sliding agent-containing layer is preferably provided on both of light-sensitive layer surface and backing layer surface. Preferred sliding property is a dynamic friction coefficient of from 0.01 to 0.25. Measurement at this time is conducted using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agent which can be used in the present invention include polyorganosiloxane, higher fatty acid amide, higher fatty acid metal salt, higher fatty acid and higher alcohol ester. As polyorganosiloxane, polydimethylsiloxane, polydiethylsiloxane, polystyrylmethylsiloxane, and polymethylphenylsiloxane can be used. The addition layer is preferably the outermost layer of the emulsion layer or a backing layer. In particular, polydimethylsiloxane or esters having a long chain alkyl group are preferred.

The photographic material according to the present invention preferably contains a matting agent. The matting agent may be added to either of the emulsion layer side or the backing layer side but it is particularly preferably to be added to the outermost layer of the emulsion layer. The matting agent may be either soluble or insoluble in the processing solution, preferably both types are used in combination. For example, polymethyl methacrylate, poly(methyl methacrylate/methacrylic acid=9/1 or 5/5 (mol ratio)), and polystyrene grains are preferably used. The average grain size is preferably from 0.8 to 10 $\mu$m, and grain size distribution is preferably narrow, preferably grains having a grain size range of from 0.9 to 1.1 times of the average grain size occupy 90% or more of the entire grain number. For increasing the matting property, fine grains having a grain size of 0.8 $\mu$m or less are preferably added at the same time. For example, polymethyl methacrylate (0.2 $\mu$m), poly(methyl methacrylate/methacrylic acid=9/1 (mol ratio), 0.3 $\mu$m), polystyrene grains (0.25 $\mu$m), and colloidal silica (0.03 $\mu$m) can be cited.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide grains, nonionic, anionic, cationic and betaine based surfactants or polymers can be preferably used. Such a patrone static prevented is disclosed in JP-A-1-312537 and JP-A-1-312538. In particular, those having the resistivity of $10^{12}\Omega$ or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 cm$^3$ or less and preferably 25 cm$^3$ or less. The weight of the plastics used for the patrone and patrone case is preferably from 5 g to 15 g.

Further, the patrone may be a type of sending out the film by revolving a spool. Further, it may be the structure such that the tip of the film-is encased in the body of the patrone and the tip of the film is sent to outside through the port of the patrone by revolving the axle of the spool in the feeding direction of the film. These are disclosed in U.S. Pat. Nos. 4,834,306 and 5,226,613. The photographic film stored in the patrones may be a so-called raw film before development or may be a photographic film development processed. Further, a raw film and a processed film may be contained in one and the same new patrone, or may be stored in different patrones.

The present invention will be illustrated in more detail with reference to examples below, but these are not to be construed as limiting the invention.

EXAMPLE 1

Preparation of Emulsion Nos. 1 to 17

An aqueous solution containing silver nitrate at concentration of 0.5 M and an aqueous solution containing potassium bromide at concentration of 0.5 M were added by a double jet method in an amount of 42 ml, respectively, over 25 seconds, to 1.0 liter of a 0.6 wt % gelatin aqueous solution (containing Gelatin A) containing potassium bromide at concentration of 0.08 M with stirring, while maintaining the temperature at 40° C. (The unit "M" as used herein means molarity which is defined as the number of mols of solute dissolved in one liter of solution.) After 30 ml of a solution containing potassium bromide at concentration of 0.8 M was added thereto, the temperature was raised to 55° C. The temperature of the reaction solution was maintained at 55° C. for further 30 minutes, then an aqueous solution containing 15 g of Gelatin B was added thereto, subsequently an aqueous solution containing 60 g of silver nitrate and an aqueous solution of potassium bromide were added to the reaction mixture over 60 minutes at an accelerated feeding rate (the feeding rate of the final rate was 19 times of the initial rate). The pBr was maintained at 1.8 all that while. Further, 36 ml of an aqueous solution containing potassium iodide at concentration of 0.5 M was added, then an aqueous solution containing 90 g of silver nitrate and an aqueous solution of potassium bromide, while maintaining the pBr at 1.9, were added thereto over 10 minutes at an accelerated feeding rate (the feeding rate of the final rate was 10 times of the initial rate). The emulsion was desalted by ordinary flocculation, after pH and pAg were adjusted to 6.5 and 8.5, respectively, at 40° C., sodium thiosulfate, potassium chloroaurate and potassium thiocyanate were added and chemical sensitization was conducted optimally. Emulsion Nos. 1 to 17 were prepared by using Gelatin A and Gelatin B shown in Table 1, changing feeding rates of the aqueous solution of silver nitrate and the aqueous solution of potassium bromide added at the nucleation process, the pBr during grain growth process and the amount of silver iodide at the grain growth process. In each emulsion, tabular grains occupied 98% or more of the total projected area of all the grains having the diameter of circle corresponding to the projected area of 0.2 μm or more.

Preparation of Emulsion Nos. 18 to 21

An aqueous solution containing silver nitrate at concentration of 0.5 M and an aqueous solution containing potassium bromide at concentration of 0.5 M were added by a double jet method in an amount of 42 ml, respectively, over 25 seconds, to 1.0 liter of a 0.6 wt % gelatin aqueous solution (containing Gelatin A) containing potassium bromide at concentration of 0.08 M with stirring, while maintaining the temperature at 40° C. After 30 ml of a solution containing potassium bromide at concentration of 0.8 M was added thereto, the temperature was raised to 55° C. The temperature of the reaction solution was maintained at 55° C. for further 30 minutes, then an aqueous solution containing 15 g of Gelatin B was added thereto, subsequently an aqueous solution containing 60 g of silver nitrate and an aqueous solution of potassium bromide containing 3.0 g of potassium iodide were added to the reaction mixture over 60 minutes at an accelerated feeding rate (the feeding rate of the final rate was 19 times of the initial rate). The pBr was maintained at 1.8 all that while. Further, an aqueous solution containing 90 g of silver nitrate and an aqueous solution of potassium bromide, while maintaining the pBr at 1.9, were added thereto over 10 minutes at an accelerated feeding rate (the feeding rate of the final rate was 10 times of the initial rate). The emulsion was desalted by ordinary flocculation, after pH and pAg were adjusted to 6.5 and 8.5, respectively, at 40° C., sodium thiosulfate, potassium chloroaurate and potassium thiocyanate were added and chemical sensitization was conducted optimally.

Emulsion Nos. 18 to 21 were prepared by using Gelatin A and Gelatin B shown in Table 1, changing feeding rates of the aqueous solution of silver nitrate and the aqueous solution of potassium bromide added at the nucleation process, the pBr during grain growth process and the amount of silver iodide at the grain growth process. In each emulsion, tabular grains occupied 98% or more of the total projected area of all the grains having the diameter of circle corresponding to the projected area of 0.2 μm or more.

Dislocation lines of 600 grains were observed by direct electron microphotographs and evaluation was conducted for the presence of dislocation lines of 10 or more in 50% or more of the total number of the grains.

TABLE 1

| | Gelatin A | | Gelatin B | | | | | | Grain | Presence |
|---|---|---|---|---|---|---|---|---|---|---|
| Emulsion No. | Molecular Weight | Phthalation Rate (%) | Molecular Weight | Phthalation Rate (%) | Content of Methionine (μmol/g) | Grain Size (μm) | Content of Iodide (%) | Average Aspect Ratio | Size Distribution (%) | of Dislocation Lines* |
| 1 Comparison | 80,000 | 0 | 80,000 | 0 | 38 | 0.5 | 2.0 | 2.5 | 42 | yes |
| 2 Comparison | 80,000 | 0 | 80,000 | 0 | 38 | 0.5 | 2.0 | 4.1 | 58 | yes |
| 3 Comparison | 10,000 | 0 | 80,000 | 0 | 38 | 0.5 | 2.0 | 3.0 | 31 | yes |
| 4 Comparison | 10,000 | 0 | 80,000 | 0 | 38 | 0.5 | 2.0 | 5.8 | 46 | yes |
| 5 Invention | 52,000 | 0 | 100,000 | 98 | 36 | 0.5 | 2.0 | 5.8 | 28 | yes |
| 6 Invention | 10,000 | 0 | 100,000 | 52 | 36 | 0.5 | 2.0 | 5.9 | 25 | yes |
| 7 Invention | 10,000 | 0 | 100,000 | 73 | 36 | 0.5 | 2.0 | 6.1 | 21 | yes |
| 8 Invention | 10,000 | 0 | 100,000 | 98 | 36 | 0.5 | 2.0 | 7.2 | 18 | yes |
| 9 Invention | 10,000 | 62 | 100,000 | 98 | 36 | 0.5 | 2.0 | 8.8 | 15 | yes |
| 10 Invention | 9,000 | 78 | 100,000 | 98 | 36 | 0.5 | 2.0 | 9.0 | 13 | yes |
| 11 Invention | 8,000 | 96 | 100,000 | 98 | 36 | 0.5 | 2.0 | 9.2 | 11 | yes |
| 12 Comparison | 80,000 | 0 | 80,000 | 0 | 36 | 1.4 | 1.0 | 5.3 | 36 | yes |
| 13 Comparison | 10,000 | 0 | 80,000 | 0 | 36 | 1.4 | 1.0 | 5.4 | 35 | yes |

TABLE 1-continued

| Emulsion No. | Gelatin A Molecular Weight | Gelatin A Phthalation Rate (%) | Gelatin B Molecular Weight | Gelatin B Phthalation Rate (%) | Content of Methionine (μmol/g) | Grain Size (μm) | Content of Iodide (%) | Average Aspect Ratio | Grain Size Distribution (%) | Presence of Dislocation Lines* |
|---|---|---|---|---|---|---|---|---|---|---|
| 14 Invention | 9,000 | 96 | 100,000 | 98 | 36 | 1.4 | 1.0 | 8.6 | 13 | yes |
| 15 Invention | 9,000 | 96 | 100,000 | 98 | 36 | 1.4 | 1.0 | 10.7 | 12 | yes |
| 16 Invention | 9,000 | 96 | 100,000 | 97 | 31 | 1.4 | 1.0 | 9.8 | 16 | yes |
| 17 Invention | 9,000 | 96 | 100,000 | 99 | 15 | 1.4 | 1.0 | 8.9 | 18 | yes |
| 18 Comparison | 80,000 | 0 | 80,000 | 0 | 38 | 0.5 | 2.0 | 3.5 | 41 | no |
| 19 Comparison | 10,000 | 0 | 80,000 | 0 | 38 | 0.5 | 2.0 | 4.1 | 30 | no |
| 20 Invention | 10,000 | 0 | 100,000 | 98 | 36 | 0.5 | 2.0 | 6.7 | 17 | no |
| 21 Invention | 8,000 | 96 | 100,000 | 98 | 36 | 0.5 | 2.0 | 7.2 | 12 | no |

*yes: Emulsion in which 10 or more dislocation lines were observed in 50% or more of the total number of the grains.
no: Emulsion in which 10 or more dislocation lines were not observed in 50% or more of the total number of the grains.

As can be seen from the results in Table 1, silver halide emulsions having a high aspect ratio and small grain size distribution can be obtained according to the constitution of the present invention. For example, Emulsion Nos. 1 to 4 show that when aspect ratios are high, grain size distributions become large (comparison between Emulsion Nos. 1 and 2 or between Emulsion Nos. 3 and 4). On the contrary, as in Emulsion Nos. 5 to 11 and 14 to 17, using the constitutions of Gelatins A and B according to the present invention, silver halide emulsions having a high aspect ratio and small grain size distribution can be obtained.

EXAMPLE 2

Preparation of Sample No. 200

A multilayer color photographic material was prepared as Sample No. 200 by coating each layer having the following composition on an undercoated cellulose triacetate film support having the thickness of 127 μm. The numeral corresponding to each component indicates the addition amount per $m^2$. The function of the compounds added is not limited to the use described. Emulsions used in Sample No. 200 are shown in the table below.

The Silver Iodobromide Emulsions Used in Sample No. 200

| Emulsion Name | Characteristics of Grain | Average Grain Size of Corresponding Sphere (μm) | Variation Coefficient (%) | Silver Iodide Content (%) |
|---|---|---|---|---|
| A | Cubic grains | 0.35 | 16 | 4.0 |
| B | Tetradecahedral internal latent image type grains | 0.45 | 10 | 2.0 |
| C | Polydisperse twin grains (internal high iodide type core/shell grains) | 0.80 | 32 | 6.0 |
| D | Polydisperse twin grains | 1.10 | 34 | 6.0 |
| E | Polydisperse twin grains | 0.30 | 31 | 6.5 |
| F | Polydisperse twin grains | 0.40 | 33 | 5.5 |
| G | Cubic internal latent image type grains | 0.45 | 11 | 4.5 |
| H | Tabular grains, average aspect ratio: 2.8 | 0.50 | 15 | 5.0 |
| I | Tabular grains, average aspect ratio: 2.2 | 0.70 | 34 | 2.0 |
| J | Tabular grains, average aspect ratio: 2.1 | 0.30 | 36 | 3.5 |
| K | Tabular grains, average aspect ratio: 4.3 | 0.40 | 15 | 5.0 |
| L | Octahedral grains | 0.45 | 14 | 5.0 |
| M | Tabular grains, average aspect ratio: 6.1 | 0.65 | 18 | 5.0 |
| N | Polydisperse twin grains (internal high iodide type core/shell grains) | 1.40 | 37 | 1.0 |

Sensitizing Dyes Added to Emulsions A to N

| Emulsion Name | Sensitizing Dye Added | Addition Amount per Mol of Silver Halide (g) |
|---|---|---|
| A | S-1 | 0.15 |
| | S-2 | 0.05 |
| | S-3 | 0.02 |
| B | S-1 | 0.20 |
| | S-2 | 0.03 |
| | S-3 | 0.21 |
| C | S-1 | 0.15 |
| | S-2 | 0.03 |
| | S-3 | 0.02 |
| D | S-8 | 0.11 |
| | S-3 | 0.07 |
| E | S-4 | 0.50 |
| | S-5 | 0.08 |
| F | S-4 | 0.30 |
| | S-5 | 0.06 |
| G | S-4 | 0.30 |
| | S-5 | 0.07 |
| H | S-4 | 0.21 |
| | S-9 | 0.09 |
| | S-5 | 0.05 |
| I | S-9 | 0.32 |
| | S-5 | 0.02 |
| J | S-6 | 0.30 |
| | S-7 | 0.03 |
| K | S-6 | 0.15 |
| | S-7 | 0.05 |
| L | S-6 | 0.20 |
| | S-7 | 0.08 |
| M | S-6 | 0.25 |
| | S-7 | 0.01 |
| N | S-6 | 0.18 |
| | S-7 | 0.09 |

First Layer: Antihalation Layer

| | | | |
|---|---|---|---|
| Black Colloidal Silver | | 0.20 | g |
| Gelatin | | 1.90 | g |
| Ultraviolet Absorber U-1 | | 0.10 | g |
| Ultraviolet Absorber U-3 | | 0.04 | g |
| Ultraviolet Absorber U-4 | | 0.10 | g |
| High Boiling Point Organic Solvent Oil-1 | | 0.10 | g |
| Fine Crystal Solid Dispersion of Dye E-1 | | 0.10 | g |

Second Layer: Interlayer

| | | | |
|---|---|---|---|
| Gelatin | | 0.40 | g |
| Compound Cpd-C | | 5.0 | mg |
| Compound Cpd-J | | 5.0 | mg |
| Compound Cpd-K | | 3.0 | mg |
| High Boiling Point Organic Solvent Oil-3 | | 0.10 | g |
| Fine Crystal Solid Dispersion of Dye E-1 | | 0.10 | g |
| Dye D-4 | | 0.80 | mg |

Third Layer: Interlayer

| | | | |
|---|---|---|---|
| Surface and Interior Fogged Fine Grain Silver Iodobromide Emulsion (average grain size: 0.06 μm, variation coefficient: 18%, AgI content: 1 mol %) | silver amount: | 0.050 | g |
| Yellow Colloidal Silver | silver amount: | 0.030 | g |
| Gelatin | | 0.40 | g |

Fourth Layer: Low Sensitivity Red-Sensitive Emulsion Layer

| | | | |
|---|---|---|---|
| Emulsion A | silver amount: | 0.30 | g |
| Emulsion B | silver amount: | 0.20 | g |
| Gelatin | | 0.80 | g |
| Coupler C-1 | | 0.15 | g |
| Coupler C-2 | | 0.050 | g |
| Coupler C-3 | | 0.050 | g |
| Coupler C-9 | | 0.050 | g |
| Compound Cpd-C | | 5.0 | mg |
| Compound Cpd-J | | 5.0 | mg |
| High Boiling Point Organic Solvent Oil-2 | | 0.10 | g |
| Additive P-1 | | 0.10 | g |

-continued

Sensitizing Dyes Added to Emulsions A to N

Fifth Layer: Middle Sensitivity Red-Sensitive Emulsion Layer

| | | | |
|---|---|---|---|
| Emulsion B | silver amount: | 0.20 | g |
| Emulsion C | silver amount: | 0.30 | g |
| Gelatin | | 0.80 | g |
| Coupler C-1 | | 0.20 | g |
| Coupler C-2 | | 0.050 | g |
| Coupler C-3 | | 0.20 | g |
| High Boiling Point Organic Solvent Oil-2 | | 0.10 | g |
| Additive P-1 | | 0.10 | g |

Sixth Layer: High Sensitivity Red-Sensitive Emulsion Layer

| | | | |
|---|---|---|---|
| Emulsion D | silver amount: | 0.40 | g |
| Gelatin | | 1.10 | g |
| Coupler C-1 | | 0.30 | g |
| Coupler C-2 | | 0.10 | g |
| Coupler C-3 | | 0.70 | g |
| Additive P-1 | | 0.10 | g |

Seventh Layer: Interlayer

| | | | |
|---|---|---|---|
| Gelatin | | 0.60 | g |
| Additive M-1 | | 0.30 | g |
| Color Mixing Preventive Cpd-I | | 2.6 | mg |
| Dye D-5 | | 0.20 | g |
| Dye D-6 | | 0.010 | g |
| Compound Cpd-J | | 5.0 | mg |
| High Boiling Point Organic Solvent Oil-1 | | 0.020 | g |

Eighth Layer: Interlayer

| | | | |
|---|---|---|---|
| Surface and Interior Fogged Silver Iodobromide Emulsion (average grain size: 0.06 μm, variation coefficient: 16%, AgI content: 0.3 mol %) | silver amount: | 0.020 | g |
| Yellow Colloidal Silver | silver amount: | 0.020 | g |
| Gelatin | | 1.00 | g |
| Additive P-1 | | 0.20 | g |
| Color Mixing Preventive Cpd-A | | 0.10 | g |
| Compound Cpd-C | | 0.10 | g |

Ninth Layer: Low Sensitivity Green-Sensitive Emulsion Layer

| | | | |
|---|---|---|---|
| Emulsion E | silver amount: | 0.10 | g |
| Emulsion F | silver amount: | 0.20 | g |
| Emulsion G | silver amount: | 0.20 | g |
| Gelatin | | 0.50 | g |
| Coupler C-4 | | 0.10 | g |
| Coupler C-7 | | 0.050 | g |
| Coupler C-8 | | 0.20 | g |
| Compound Cpd-B | | 0.030 | g |
| Compound Cpd-D | | 0.020 | g |
| Compound Cpd-E | | 0.020 | g |
| Compound Cpd-F | | 0.040 | g |
| Compound Cpd-J | | 10 | mg |
| Compound Cpd-L | | 0.020 | g |
| High Boiling Point Organic Solvent Oil-1 | | 0.10 | g |
| High Boiling Point Organic Solvent Oil-2 | | 0.10 | g |

Tenth Layer: Middle Sensitivity Green-Sensitive Emulsion Layer

| | | | |
|---|---|---|---|
| Emulsion G | silver amount: | 0.30 | g |
| Emulsion H | silver amount: | 0.10 | g |
| Gelatin | | 0.60 | g |
| Coupler C-4 | | 0.10 | g |
| Coupler C-7 | | 0.20 | g |
| Coupler C-8 | | 0.10 | g |
| Compound Cpd-B | | 0.030 | g |
| Compound Cpd-D | | 0.020 | g |
| Compound Cpd-E | | 0.020 | g |
| Compound Cpd-F | | 0.050 | g |
| Compound Cpd-L | | 0.050 | g |
| High Boiling Point Organic Solvent Oil-2 | | 0.010 | g |

Eleventh Layer: High Sensitivity Green-Sensitive Emulsion Layer

| | | | |
|---|---|---|---|
| Emulsion I | silver amount: | 0.50 | g |
| Gelatin | | 1.00 | g |
| Coupler C-4 | | 0.30 | g |
| Coupler C-7 | | 0.10 | g |
| Coupler C-8 | | 0.10 | g |

-continued

| Sensitizing Dyes Added to Emulsions A to N | | |
|---|---|---|
| Compound Cpd-B | | 0.080 g |
| Compound Cpd-E | | 0.020 g |
| Compound Cpd-F | | 0.040 g |
| Compound Cpd-K | | 5.0 mg |
| Compound Cpd-L | | 0.020 g |
| High Boiling Point Organic Solvent Oil-1 | | 0.020 g |
| High Boiling Point Organic Solvent Oil-2 | | 0.020 g |
| **Twelfth Layer: Interlayer** | | |
| Gelatin | | 0.60 g |
| Compound Cpd-L | | 0.050 g |
| High Boiling Point Organic Solvent Oil-1 | | 0.050 g |
| **Thirteenth Layer: Yellow Filter Layer** | | |
| Yellow Colloidal Silver | silver amount: | 0.090 g |
| Gelatin | | 1.10 g |
| Color Mixing Preventive Cpd-A | | 0.010 g |
| Compound Cpd-L | | 0.010 g |
| High Boiling Point Organic Solvent Oil-1 | | 0.010 g |
| Fine Crystal Solid Dispersion of Dye E-2 | | 0.050 g |
| **Fourteenth Layer: Interlayer** | | |
| Gelatin | | 0.60 g |
| **Fifteenth Layer: Low Sensitivity Blue-Sensitive Emulsion Layer** | | |
| Emulsion J | silver amount: | 0.20 g |
| Emulsion K | silver amount: | 0.30 g |
| Gelatin | | 0.80 g |
| Coupler C-5 | | 0.20 g |
| Coupler C-6 | | 0.10 g |
| Coupler C-10 | | 0.40 g |
| **Sixteenth Layer: Middle Sensitivity Blue-Sensitive Emulsion Layer** | | |
| Emulsion L | silver amount: | 0.30 g |
| Emulsion M | silver amount: | 0.30 g |
| Gelatin | | 0.90 g |
| Coupler C-5 | | 0.10 g |
| Coupler C-6 | | 0.10 g |
| Coupler C-10 | | 0.60 g |
| **Seventeenth Layer: High Sensitivity Blue-sensitive Emulsion Layer** | | |
| Emulsion N | silver amount: | 0.50 g |
| Gelatin | | 1.20 g |

-continued

| Sensitizing Dyes Added to Emulsions A to N | | |
|---|---|---|
| Coupler C-5 | | 0.10 g |
| Coupler C-6 | | 0.10 g |
| Coupler C-10 | | 0.60 g |
| High Boiling Point Organic Solvent Oil-2 | | 0.10 g |
| **Eighteenth Layer: First Protective Layer** | | |
| Gelatin | | 0.70 g |
| Ultraviolet Absorber U-1 | | 0.20 g |
| Ultraviolet Absorber U-2 | | 0.050 g |
| Ultraviolet Absorber U-5 | | 0.30 g |
| Formalin Scavenger Cpd-H | | 0.40 g |
| Dye D-1 | | 0.15 g |
| Dye D-2 | | 0.050 g |
| Dye D-3 | | 0.10 g |
| **Nineteenth Layer: Second Protective Layer** | | |
| Colloidal Silver | silver amount: | 0.10 mg |
| Fine Grain Silver Iodobromide Emulsion (average grain size: 0.06 μm, AgI content: 1 mol %) | silver amount: | 0.10 g |
| Gelatin | | 0.40 g |
| **Twentieth Layer: Third Protective Layer** | | |
| Gelatin | | 0.40 g |
| Polymethyl Methacrylate (average particle size: 1.5 μm) | | 0.10 g |
| Copolymer of Methyl Methacrylate/Acrylic Acid in Proportion of 4/6 (average particle size: 1.5 μm) | | 0.10 g |
| Silicone Oil | | 0.030 g |
| Surfactant W-1 | | 3.0 mg |
| Surfactant W-2 | | 0.030 g |

Further, Additives F-1 to F-8 were added to every emulsion layer in addition to the above components. Moreover, Gelatin Hardener H-1 and Surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

C-1

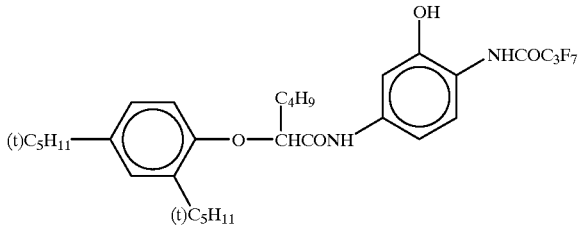

C-2

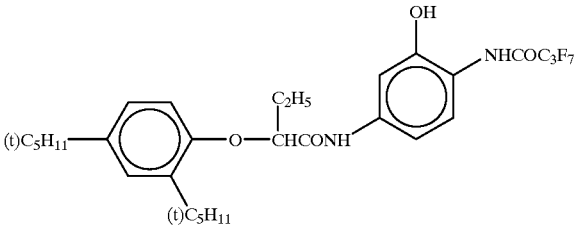

C-3

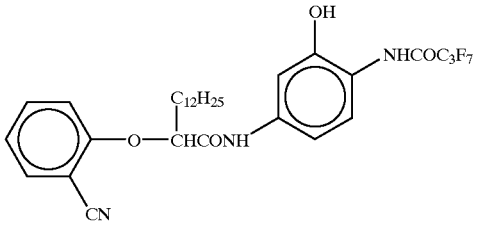

C-4

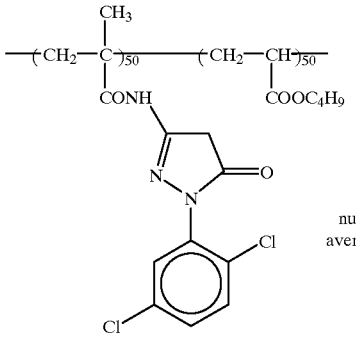

numerals indicate wt%
average molecular weight:
about 25,000

-continued
C-5
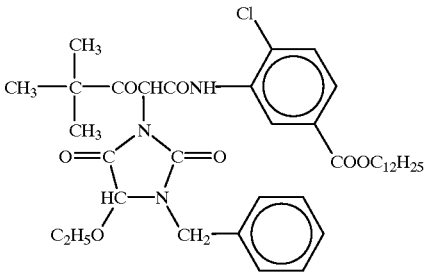
C-6
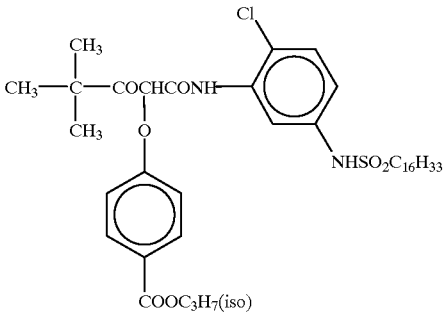
C-7
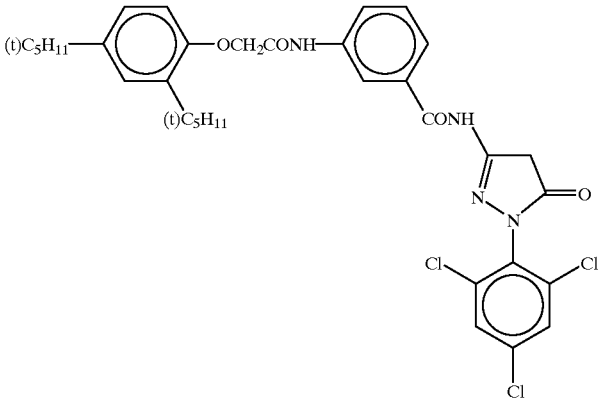
C-8
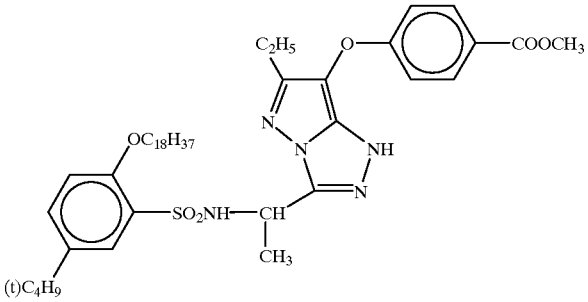
C-9
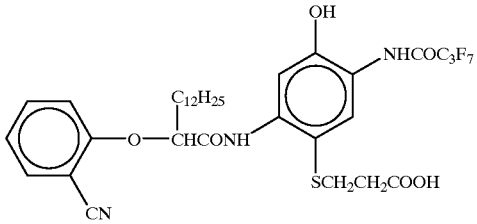
C-10
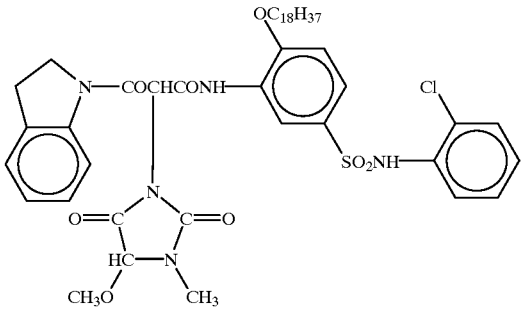
Oil-1
Dibutyl Phthalate
Oil-2
Tricresyl Phosphate
Oil-3
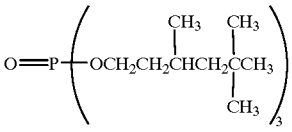

-continued
Cpd-A
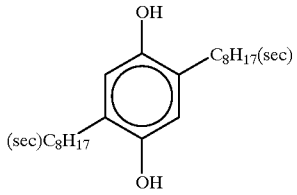
Cpd-B
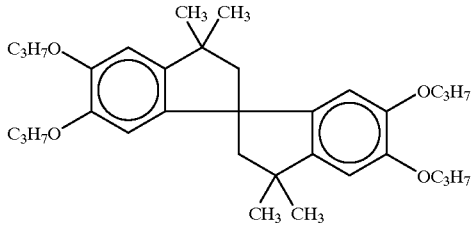
Cpd-C
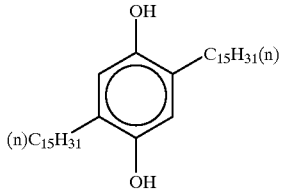
Cpd-D
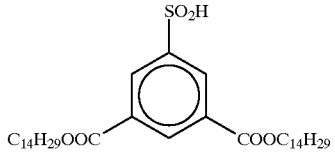
Cpd-E
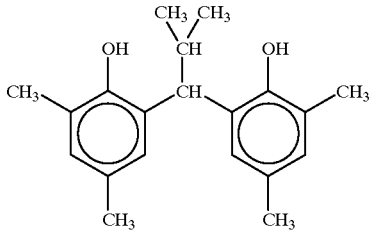
Cpd-F
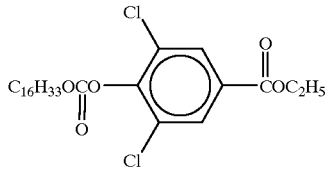
Cpd-H
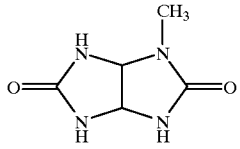
Cpd-I
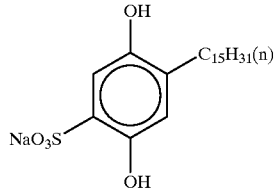
Cpd-J
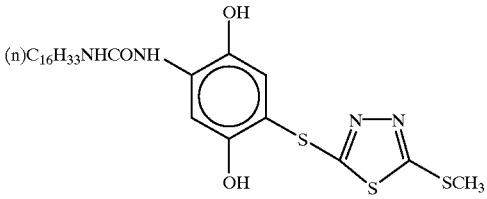
Cpd-K
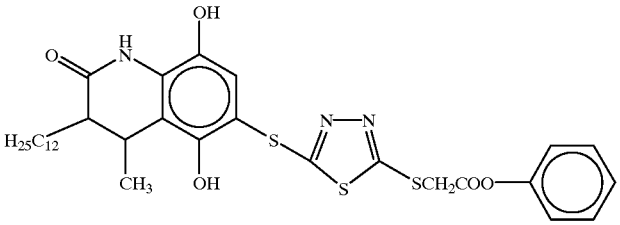
Cpd-L
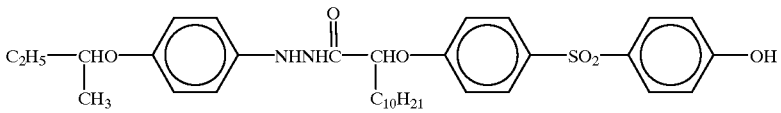

-continued
U-1
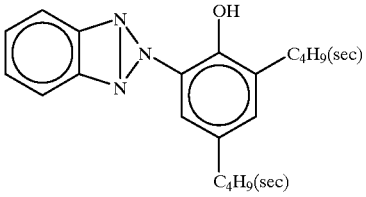
U-2
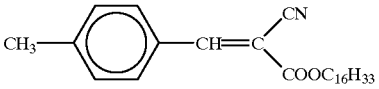
U-3
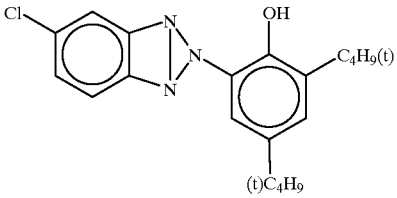
U-4
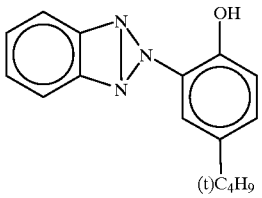
U-5
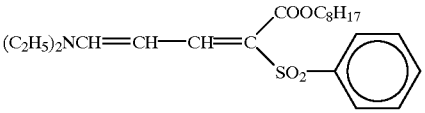
S-1
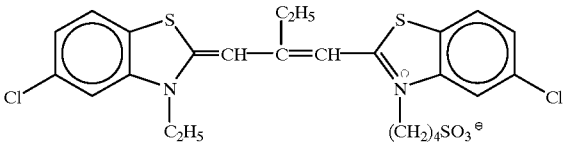
S-2
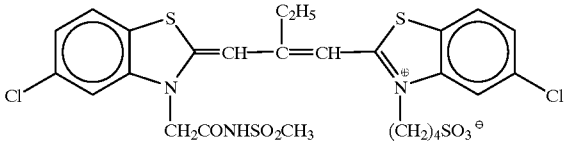
S-3
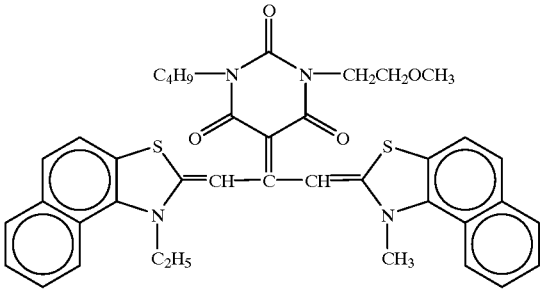
S-4
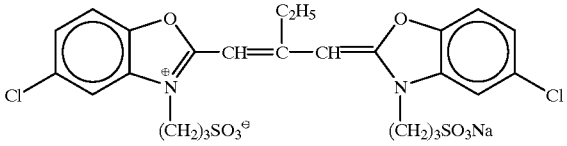
S-5
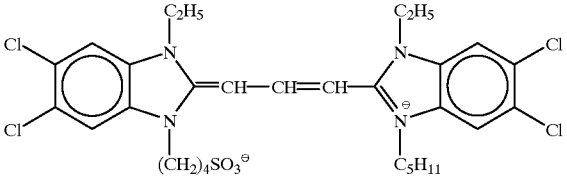
S-6
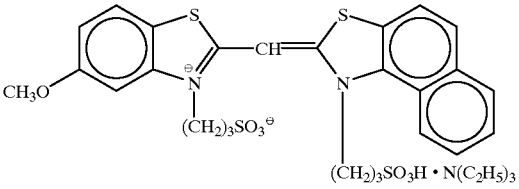
S-7
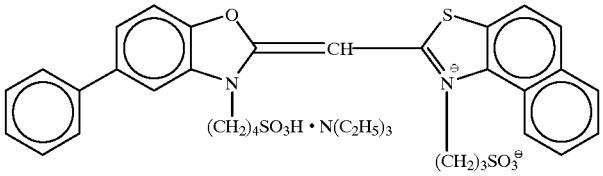

-continued
S-8
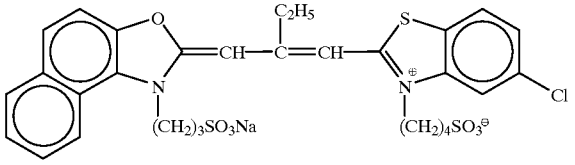
S-9
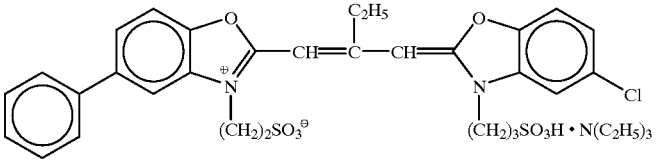
D-1
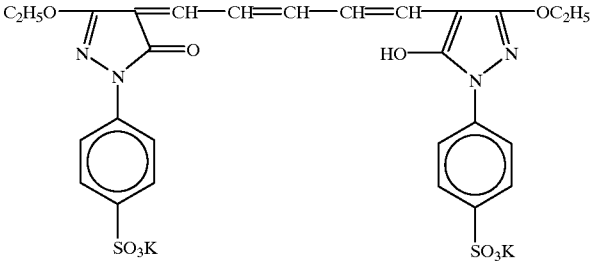
D-2
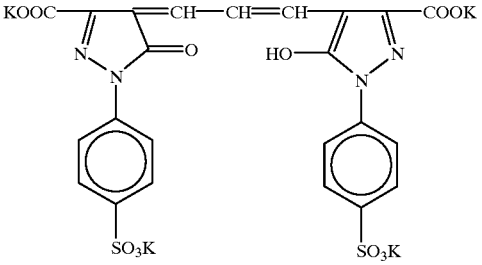
D-3
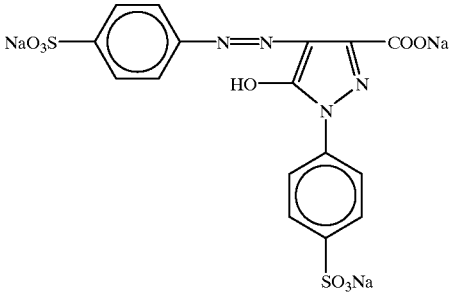
D-4
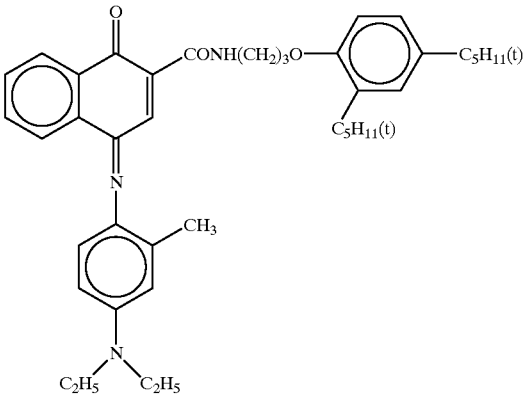
D-5
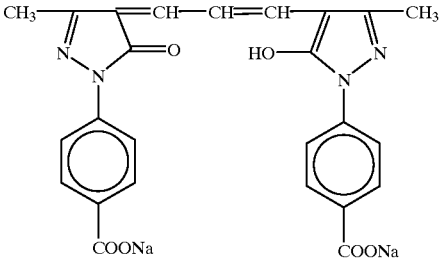
D-6
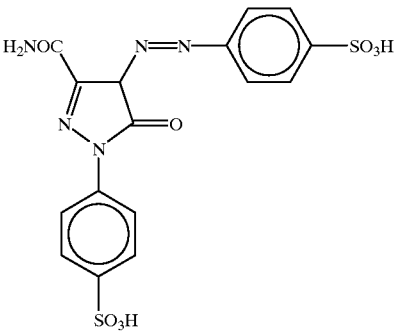
E-1
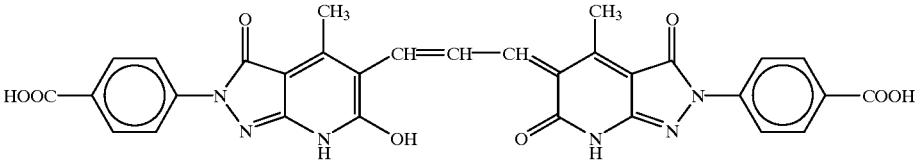

-continued
E-2
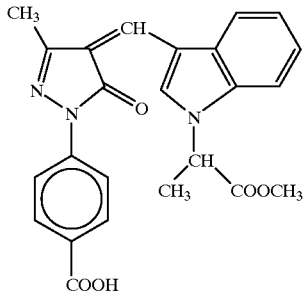
H-1
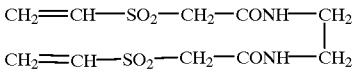
W-1
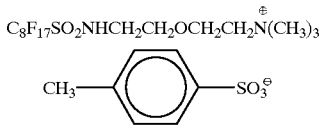
W-2
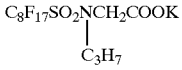
W-3
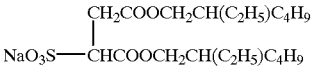
W-4
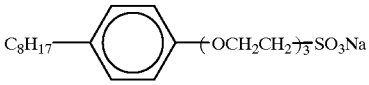
W-5
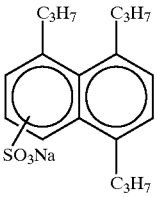
W-6
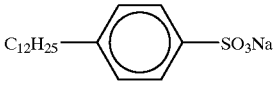
P-1
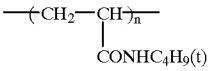
($n$ = 100–1,000)
M-1
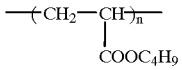
($n$ = 100–1,000)
F-1
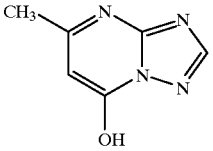
F-2
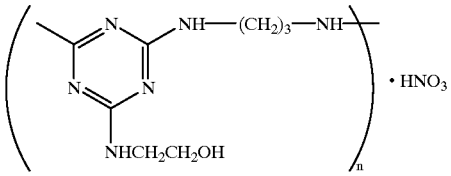
($n$ = 3 ~ 4)
F-3
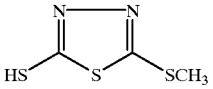
F-4
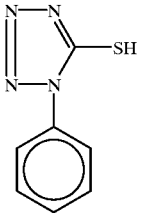
F-5
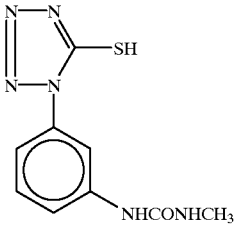
F-6
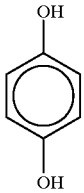

-continued

F-7

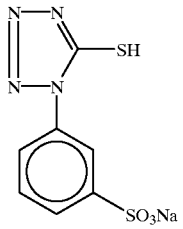

F-8

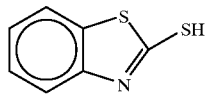

Preparation of Sample Nos. 201 to 221

Sample Nos. 201 to 215 were prepared in the same manner as the preparation of Sample No. 200 except for replacing Emulsion I in the eleventh layer of Sample No. 200 with Emulsion Nos. 1 to 11 and 18 to 21 in Table 1. Emulsion Nos. 1 to 11 and 18 to 21 were spectrally sensitized using the same sensitizing dyes as used in Emulsion I. Other compounds added and coating amounts thereof were the same as Sample No. 200. Sample Nos. 216 to 221 were prepared similarly except for replacing Emulsion N in the seventeenth layer with Emulsion Nos. 12 to 17 in Table 1.

Evaluation of Sample

Sample Nos. 201 to 221 were imagewise exposed with white light and processed according to Process A shown below, and image density obtained of each sample was measured. With respect to magenta color image density, green sensitivity is the reciprocal of the exposure amount giving density 1.0 with Sample No. 201 (or Sample No. 216) taken as 100% and expressed as relative sensitivity. Blue sensitivity was evaluated in the same manner. Each sample was subjected to exposure through an MTF pattern and after being development processed in the same manner, sharpness of each sample was measured using a micro densitometer. Sharpness was evaluated by the value at 10 cycle/mm of spatial frequency. Moreover, RMS value was measured as a criterion of graininess. Graininess was evaluated by the value at density 1.5 measured using an aperture of 48 $\mu\phi$.

The results obtained are shown in Table 2 below.

TABLE 2

| Experiment No. | Sample No. | Emulsion No. Used | Sharpness | Graininess | Sensitivity |
|---|---|---|---|---|---|
| 1 | 201 (Comparison) | Emulsion No. 1 | 1.03 | 0.031 | 100 |
| 2 | 202 (Comparison) | Emulsion No. 2 | 1.02 | 0.030 | 102 |
| 3 | 203 (Comparison) | Emulsion No. 3 | 1.03 | 0.034 | 101 |
| 4 | 204 (Comparison) | Emulsion No. 4 | 1.04 | 0.032 | 103 |
| 5 | 205 (Invention) | Emulsion No. 5 | 1.18 | 0.025 | 108 |
| 6 | 206 (Invention) | Emulsion No. 6 | 1.18 | 0.021 | 109 |
| 7 | 207 (Invention) | Emulsion No. 7 | 1.21 | 0.020 | 111 |
| 8 | 208 (Invention) | Emulsion No. 8 | 1.23 | 0.018 | 112 |
| 9 | 209 (Invention) | Emulsion No. 9 | 1.25 | 0.017 | 111 |
| 10 | 210 (Invention) | Emulsion No. 10 | 1.27 | 0.015 | 112 |
| 11 | 211 (Invention) | Emulsion No. 11 | 1.28 | 0.014 | 111 |
| 12 | 212 (Comparison) | Emulsion No. 18 | 1.04 | 0.032 | 81 |
| 13 | 213 (Comparison) | Emulsion No. 19 | 1.03 | 0.035 | 76 |
| 14 | 214 (Invention) | Emulsion No. 20 | 1.27 | 0.024 | 107 |
| 15 | 215 (Invention) | Emulsion No. 21 | 1.27 | 0.025 | 106 |
| The above are data of green-sensitive layers. | | | | | |
| 16 | 216 (Comparison) | Emulsion No. 12 | 1.00 | 0.052 | 100 |
| 17 | 217 (Comparison) | Emulsion No. 13 | 1.01 | 0.050 | 101 |
| 18 | 218 (Invention) | Emulsion No. 14 | 1.23 | 0.031 | 109 |
| 19 | 219 (Invention) | Emulsion No. 15 | 1.25 | 0.030 | 110 |

TABLE 2-continued

| Experiment No. | Sample No. | Emulsion No. Used | Sharpness | Graininess | Sensitivity |
|---|---|---|---|---|---|
| 20 | 220 (Invention) | Emulsion No. 16 | 1.18 | 0.034 | 112 |
| 21 | 221 (Invention) | Emulsion No. 17 | 1.16 | 0.038 | 114 |
| The above are data of blue-sensitive layers. | | | | | |

From the results in Table 2, it can be seen that photographic materials excellent in sensitivity, graininess and sharpness can be obtained using the emulsions according to the present invention.

Sample Nos. 205 to 211, 214 and 215 in which gelatins according to the present invention were used showed excellent valus in every of sensitivity, graininess and sharpness in comparison with Sample Nos. 201 to 204, 212 and 213 in which conventional gelatins were used.

Sample Nos. 218 to 221 in which emulsions of the present invention were used in blue-sensitive layers are excellent in sensitivity, graininess and sharpness compared with Sample Nos. 216 and 217.

Process A

| Processing Step | Processing Time (min) | Processing Temperature (° C.) | Tank Capacity (liter) | Replenishing Rate (ml/m$^2$) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 2 | 220 |
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| First Developing Solution | Tank Solution | Replenisher |
|---|---|---|
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinonemonosulfonate | 20 g | 20 g |

-continued

| | | |
|---|---|---|
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |

| Reversal Solution | Tank Solution | Replenisher |
|---|---|---|
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |

| Color Developing Solution | Tank Solution | Replenisher |
|---|---|---|
| Pentasodium Nitrilo-N,N,N-trimethylenephosphonate | 2.0 g | 2.0 g |
| Sodium Sulfite | 7.0 g | 7.0 g |
| Trisodium Phosphate 12 Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline•3/2 Sulfate•Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |

| Pre-bleaching Solution | Tank Solution | Replenisher |
|---|---|---|
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic acid or sodium hydroxide) | 6.30 | 6.10 |

| Bleaching Solution | Tank Solution | Replenisher |
|---|---|---|
| Disodium Ethylenediaminetetraacetate Dihydrate | 2.0 g | 4.0 g |
| Ammonium Ethylenediaminetetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |

| Fixing Solution | Tank Solution | Replenisher |
|---|---|---|
| Ammonium Thiosulfate | 80 g | same as the tank solution |

-continued

| | | |
|---|---|---|
| Sodium Sulfite | 5.0 g | same as the tank solution |
| Sodium Bisulfite | 5.0 g | same as the tank solution |
| Water to make | 1,000 ml | same as the tank solution |
| pH (adjusted with acetic acid or aqueous ammonia) | 6.60 | |

| Stabilizing Solution | Tank Solution | Replenisher |
|---|---|---|
| 1,2-Benzisothiazolin-3-one | 0.02 g | 0.03 g |
| Polyoxyethylene-p-monononylphenyl Ether (average polymerization degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

EXAMPLE 3

Preparation of Emulsion

Preparation of Emulsion No. 1' (Comparison)

Three liters of an aqueous solution containing 1.2 g of alkali-processed gelatin having a weight average molecular weight of 8,000, 50 ml of 1 N nitric acid, 1.0 g of KBr and 5.0 g of a polyalkylene oxide block copolymer PLURONIC TM31R1 (disclosed in EP-A-514742) was put in a reaction vessel, and while stirring at 40° C., 30 ml of an aqueous solution containing 1.2 g of $AgNO_3$ and 30 ml of an aqueous solution containing 0.85 g of KBr were added thereto over 1 minute. The temperature was raised to 75° C. over 18 minutes, 17.5 ml of an aqueous solution containing 7.0 g of KBr was added thereto, 70 ml of 20% ammonium sulfate and 200 ml of 1 N NaOH were added 4 minutes after the completion of addition, and the reaction mixture was further stirred for 6 minutes. Subsequently, 50 g of common alkali-processed Gelatin a (deionized alkali-processed ossein gelatin having a weight average molecular weight of 30,000 and a methionine content of 36 μmol/g) and 130 ml of 1 N nitric acid were added thereto. Thereafter, an aqueous solution containing 10 g of $AgNO_3$ and an aqueous solution containing 7 g of KBr were added at a constant feeding rate over 5 minutes. Then, an aqueous solution containing 300 g of $AgNO_3$ and an aqueous solution containing KBr were added over 50 minutes so as to maintain pBr at 2.0 with accelerating the feeding rate.

The thus-formed emulsion grains were desalted and washed by ordinary flocculation, and pH and pAg were adjusted to 5.0 and 7.5, respectively, at 40° C. This was designated Seed Crystal Emulsion A.

The above emulsion (Seed Crystal Emulsion A) was divided into three equal parts and one part of them was dissolved in 1 liter of an aqueous solution containing 3 wt % of common alkali-processed Gelatin a (deionized alkali-processed ossein gelatin having a weight average molecular weight of 30,000 and a methionine content of 36 μmol/g), and pAg and pH were adjusted to 8.9 and 5.6, respectively, and the temperature was maintained at 40° C. Then, an aqueous solution containing 11.4 g of sodium p-iodoacetamidobenzenesulfonate was added thereto with stirring, an aqueous solution containing 5.3 g of sodium sulfite was added at a constant feeding rate over 5 minutes, pH was maintained at 8.5, and pH was adjusted to 5.6 after 10 minutes. Subsequently, a solution containing 70 g of $AgNO_3$ and a solution containing 50 g of KBr were added over 30 minutes at a constant feeding rate. The reaction mixture was then desalted by ordinary flocculation, common alkali-processed gelatin (deionized alkali-processed ossein gelatin having a weight average molecular weight of 70,000 and a methionine content of 63 μmol/g) was added so as to reach the gelatin content of 6.5 wt %, and pH and pAg were adjusted to 6.6 and 8.6, respectively, at 40° C.

The reaction product was optimally subjected to chemical sensitization by sodium thiosulfate, potassium selenocyanate, chloroauric acid and potassium thiocyanate in the presence of Sensitizing Dyes S-6 and S-7 as shown above. Subsequently, silver bromide Lippmann emulsion in an amount corresponding to 2 g in terms of silver was added, stirred for 20 minutes at 60° C., and then quenched to obtain comparative tabular Emulsion No. 1'.

The obtained emulsion was an AgBrI emulsion having an AgI content of 2.0 mol %, the average projected area diameter of the grains in the emulsion was 1.73 μm, the average thickness of the grains was 0.20 μm, tabular grains occupied 99% of the total projected area of all the grains having the projected area diameter of 0.2 μm or more, the average aspect ratio was 8.7, the average tabularity was 43.3, and the variation coefficient of grain size was 7.4%. The variation coefficient of iodide distribution among grains was 12.2%. From the observation of these tabular grains by a low temperature direct transmission electron microscope, 10 or more dislocation lines per one grain were observed.

Preparation of Emulsion No. 2'

In the same manner as the preparation of Emulsion No. 1', one-third of Seed Crystal Emulsion A was dissolved in 1 liter of an aqueous solution containing 3 wt % of common alkali-processed Gelatin a (deionized alkali-processed ossein gelatin having a weight average molecular weight of 30,000 and a methionine content of 36 μmol/g), and pAg and pH were adjusted to 8.9 and 5.6, respectively. The temperature was raised to 75° C., and 290 ml of an aqueous solution containing 5.2 g of KI was added alone over 5 minutes. After 2 minutes, a solution containing 70 g of $AgNO_3$ and a solution containing 50 g of KBr were added over 30 minutes at a constant feeding rate. The reaction mixture was then desalted by ordinary flocculation, common alkali-processed gelatin (deionized alkali-processed ossein gelatin having a weight average molecular weight of 70,000 and a methionine content of 63 μmol/g) was added so as to reach the gelatin content of 6.5 wt %, and pH and pAg were adjusted to 6.6 and 8.6, respectively, at 40° C.

In the same manner as the preparation of Emulsion No. 1', the reaction product was optimally subjected to chemical sensitization by sodium thiosulfate, potassium selenocyanate, chloroauric acid and potassium thiocyanate in the presence of Sensitizing Dyes S-6 and S-7 as shown above. Subsequently, silver bromide Lippmann emulsion in an amount corresponding to 2 g in terms of silver was added, stirred for 20 minutes at 60° C., and then quenched to obtain comparative tabular Emulsion No. 2'.

The obtained emulsion was an AgBrI emulsion having an AgI content of 2.0 mol %, the average projected area diameter of the grains in the emulsion was 1.74 μm, the average thickness of the grains was 0.19 μm, tabular grains occupied 99% of the total projected area of all the grains having the projected area diameter of 0.2 μm or more, the average aspect ratio was 9.2, the average tabularity was 48.5, and the variation coefficient of grain size was 8.1%. The variation coefficient of iodide distribution among grains was 34.7%.

Preparation of Emulsion No. 3' (Invention)

Emulsion No. 3' was prepared in the same manner as the preparation of Emulsion No. 1', except for replacing Gelatin a with Modified Gelatin b (phthalated gelatin of Gelatin a with a phthalation rate of 96%).

Emulsion No. 3' was an AgBrI emulsion having an AgI content of 2.0 mol %, the average projected area diameter of the grains in the emulsion was 1.95 μm, the average thickness of the grains was 0.16 μm, tabular grains occupied 99% of the total projected area of all the grains having the projected area diameter of 0.2 μm or more, the average aspect ratio was 12.2, the average tabularity was 76.2, and the variation coefficient of grain size was 4.5%. The variation coefficient of iodide distribution among grains was 8.7%. From the observation of these tabular grains by a low temperature direct transmission electron microscope, 10 or more dislocation lines per one grain were observed.

Preparation of Emulsion No. 4' (Comparison)

Emulsion No. 4' was prepared in the same manner as the preparation of Emulsion No. 2', except for replacing Gelatin a with Modified Gelatin b (phthalated gelatin of Gelatin a with a phthalation rate of 96%).

Emulsion No. 4' was an AgBrI emulsion having an AgI content of 2.0 mol %, the average projected area diameter of the grains in the emulsion was 1.97 μm, the average thickness of the grains was 0.16 μm, tabular grains occupied 99% of the total projected area of all the grains having the projected area diameter of 0.2 μm or more, the average aspect ratio was 12.3, the average tabularity was 77.0, and the variation coefficient of grain size was 5.1%. The variation coefficient of iodide distribution among grains was 32.1%.

Preparation of Emulsion No. 5' (Comparison)

Emulsion No. 5' was prepared in the same manner as the preparation of Emulsion No. 1', except for replacing Gelatin a with low methionine content Gelatin c (Gelatin a was oxidation-processed, methionine content: 9 μmol %).

Emulsion No. 5' was an AgBrI emulsion having an AgI content of 2.0 mol %, the average projected area diameter of the grains in the emulsion was 2.02 μm, the average thickness of the grains was 0.16 μm, tabular grains occupied 99% of the total projected area of all the grains having the projected area diameter of 0.2 μm or more, the average aspect ratio was 12.6, the average tabularity was 78.9, and the variation coefficient of grain size was 11.4%. The variation coefficient of iodide distribution among grains was 15.6%.

Preparation of Emulsion No. 6'

3.7 liters of an aqueous solution containing 30 g of common alkali-processed Gelatin a (deionized alkali-processed ossein gelatin having a weight average molecular weight of 30,000 and a methionine content of 36 μmol/g) and 6.0 g of KBr was put in a reaction vessel, and while stirring at 55° C., an aqueous solution containing 10 g of $AgNO_3$ and an aqueous solution containing 7 g of KBr were added thereto over 1 minute. 300 ml of an aqueous solution containing 50 g of alkali-processed Gelatin a (deionized alkali-processed ossein gelatin having a weight average molecular weight of 30,000 and a methionine content of 36 μmol/g) was added thereto, 70 ml of 20% ammonium sulfate and 200 ml of 1 N NaOH were added 20 minutes after the completion of addition, and the reaction mixture was further stirred for 5 minutes. Thereafter, an aqueous solution containing 20 g of $AgNO_3$ was added at a constant feeding rate. Then, an aqueous solution containing 120 g of $AgNO_3$ and an aqueous solution containing KBr were added over 30 minutes so as to maintain pBr at 2.0 with accelerating the feeding rate. 190 ml of an aqueous solution containing 5.1 g of KI was added alone over 5 minutes. After 2 minutes, a solution containing 110 g of $AgNO_3$ and a solution containing KBr were added over 30 minutes at a constant feeding rate. The reaction mixture was then desalted by ordinary flocculation, common alkali-processed gelatin (deionized alkali-processed ossein gelatin having a weight average molecular weight of 70,000 and a methionine content of 63 μmol/g) was added so as to reach the gelatin content of 6.5 wt %, and pH and pAg were adjusted to 6.6 and 8.6, respectively, at 40° C.

The reaction product was optimally subjected to chemical sensitization by sodium thiosulfate, potassium selenocyanate, chloroauric acid and potassium thiocyanate in the presence of Sensitizing Dyes S-6 and S-7 as shown above. Subsequently, silver bromide Lippmann emulsion in an amount corresponding to 2 g in terms of silver was added, stirred for 20 minutes at 60° C., and then quenched to obtain comparative tabular Emulsion No. 6'.

The obtained emulsion was an AgBrI emulsion having an AgI content of 2.0 mol %, the average projected area diameter of the grains in the emulsion was 1.74 μm, the average thickness of the grains was 0.20 μm, tabular grains occupied 89% of the total projected area of all the grains having the projected area diameter of 0.2 μm or more, the average aspect ratio was 8.7, the average tabularity was 43.5, and the variation coefficient of grain size was 38%. The variation coefficient of iodide distribution among grains was 37.2%.

Preparation of Emulsion No. 7' (Invention)

Emulsion No. 7' was prepared in the same manner as the preparation of Emulsion No. 1' except for replacing Gelatin a with Modified Gelatin b (phthalated gelatin of Gelatin a with a phthalation rate of 96%) until the preparation of seed crystal emulsion.

Emulsion No. 7' was an AgBrI emulsion having an AgI content of 2.0 mol %, the average projected area diameter of the grains in the emulsion was 1.89 μm, the average thickness of the grains was 0.16 μm, tabular grains occupied 99% of the total projected area of all the grains having the projected area diameter of 0.2 μm or more, the average aspect ratio was 11.8, the average tabularity was 73.8, and the variation coefficient of grain size was 4.3%. The variation coefficient of iodide distribution among grains was 11.3%. From the observation of these tabular grains by a low temperature direct transmission electron microscope, 10 or more dislocation lines per one grain were observed.

Preparation of Emulsion No. 8' (Invention)

Emulsion No. 8' was prepared in the same manner as the preparation of Emulsion No. 1' except that Gelatin a was replaced with Modified Gelatin b (phthalated gelatin of Gelatin a with a phthalation rate of 96%) until the preparation of seed crystal emulsion.

Thereafter, the seed crystal emulsion was dissolved in 1 liter of an aqueous solution containing 3 wt % of Modified Gelatin b (phthalated gelatin of Gelatin a with a phthalation rate of 96%), and pAg and pH were adjusted to 8.7 and 5.6, respectively. The temperature was raised to 50° C., and 290 ml of an aqueous solution containing 5.2 g of KI and a solution containing 5.3 g of $AgNO_3$ were added thereto at the same time over 5 minutes. After 2 minutes, a solution containing 64.7 g of $AgNO_3$ and a solution containing 50 g of KBr were added thereto over 30 minutes at a constant feeding rate. The reaction mixture was then desalted by ordinary flocculation, common alkali-processed gelatin (deionized alkali-processed ossein gelatin having a weight average molecular weight of 70,000 and a methionine content of 63 μmol/g) was added so as to reach the gelatin content of 6.5 wt %, and pH and pAg were adjusted to 6.6 and 8.6, respectively, at 40° C.

In the same manner as the preparation of Emulsion No. 1', the reaction product was optimally chemically sensitized by sodium thiosulfate, potassium selenocyanate, chloroauric acid and potassium thiocyanate in the presence of Sensitizing Dyes S-6 and S-7 as shown above. Subsequently, silver bromide Lippmann emulsion in an amount corresponding to 2 g in terms of silver was added, stirred for 20 minutes at 60° C., then quenched to obtain Emulsion No. 8'.

Emulsion No. 8' was an AgBrI emulsion having an AgI content of 2.0 mol %, the average projected area diameter of the grains in the emulsion was 1.96 μm, the average thickness of the grains was 0.16 μm, tabular grains occupied 99% of the total projected area of all the grains having the projected area diameter of 0.2 μm or more, the average aspect ratio was 12.3, the average tabularity was 76.6, and the variation coefficient of grain size was 4.8%. The variation coefficient of iodide distribution among grains was 23.6%. From the observation of these tabular grains by a low temperature direct transmission electron microscope, 10 or more dislocation lines per one grain were observed.

Preparation of Coated Sample and Evaluation Thereof

Sample No. 301 was prepared by coating the emulsion layer and the protective layer each having the following composition on an undercoated cellulose triacetate film support.

| | |
|---|---|
| (1) Emulsion Layer | |
| Emulsion 1' | silver amount: 2.15 g/m$^2$ |
| Coupler C-5 as shown above | 1.5 g/m$^2$ |
| Tricresyl Phosphate | 1.1 g/m$^2$ |
| Gelatin | 2.0 g/m$^2$ |
| (2) Protective Layer | |
| Sodium 2,4-Dichloro-6-hydroxy-s-triazine | 0.08 g/m$^2$ |
| Gelatin | 1.80 g/m$^2$ |

Sample Nos. 302 to 308 were prepared in the same manner as the preparation of Sample No. 301 except for changing the emulsions as shown in Table 3 below.

TABLE 3

| Sample No. | Emulsion No. | Gelatin | Average Projected Area Diameter | Variation Coefficient of Grain Size | Average Aspect Ratio | Average Silver Iodide Content | Distribution of Silver Iodide among Grains |
|---|---|---|---|---|---|---|---|
| 301 (Comparison) | 1' | non-modified | 1.73 | 7.4 | 8.7 | 2.0 | 12.2 |
| 302 (Comparison) | 2' | " | 1.74 | 8.1 | 9.2 | 2.0 | 34.7 |
| 303 (Invention) | 3' | phthalated | 1.95 | 4.5 | 12.2 | 2.0 | 8.7 |

TABLE 3-continued

| Sample No. | Emulsion No. | Gelatin | Average Projected Area Diameter | Variation Coefficient of Grain Size | Average Aspect Ratio | Average Silver Iodide Content | Distribution of Silver Iodide among Grains |
|---|---|---|---|---|---|---|---|
| 304 (Invention) | 4' | " | 1.97 | 5.1 | 12.3 | 2.0 | 32.1 |
| 305 (Comparison) | 5' | low methionine content | 2.02 | 11.4 | 12.6 | 2.0 | 15.6 |
| 306 (Comparison) | 6' | non-modified | 1.74 | 38.0 | 8.7 | 2.0 | 37.2 |
| 307 (Invention) | 7' | phthalated | 1.89 | 4.3 | 11.8 | 2.0 | 11.3 |
| 308 (Invention) | 8' | " | 1.96 | 4.8 | 12.3 | 2.0 | 23.6 |

Each of Sample Nos. 301 to 308 was exposed through a wedge filter for 1/100 seconds, development processed by the processing solution having the following composition at 20° C. for 4 minutes, then fixed, washed, dried, and subjected to sensitometry. Sensitivity was obtained as the reciprocal of the exposure amount giving the density of fog +0.1. The results obtained are shown in Table 4.

| Processing Solution | |
|---|---|
| 1-Phenyl-3-pyrazolidone | 0.5 g |
| Hydroquinone | 10 g |
| Disodium Ethylenediaminetetraacetate | 2 g |
| Potassium Sulfite | 60 g |
| Boric Acid | 4 g |
| Potassium Carbonate | 20 g |
| Sodium Bromide | 5 g |
| Diethylene Glycol | 20 g |
| pH was adjusted to 10.0 with sodium hydroxide | |
| Water to make | 1 liter |

After each of Sample Nos. 301 to 308 was exposed through a wedge filter for 1/100 seconds, a bending pressure was added to reach a predetermined curvature at 25° C. 60% RH, then each sample was development processed in the same manner as described above and pressure resistance (pressure resistance after exposure) was evaluated. In addition, after a bending pressure was added to each sample to reach a predetermined curvature at 25° C. 60% RH, each sample was exposed through a wedge filter for 1/100 seconds, and development processed in the same manner as described above and pressure resistance (pressure resistance before exposure) was evaluated. The density change at the pressure part provided exposure amount giving medium density between fog density of the sample to which pressure was not added and maximum density was expressed by relative value. The smaller the value, the more excellent is the pressure resistance. The results obtained are shown in Table 4 below.

Two sets of Sample Nos. 301 to 308 were prepared and after each sample was exposed through a wedge filter for 1/100 seconds, one set of samples were preserved at 35° C., 60% RH for 14 days, the other set of samples were preserved in a freezer as control, each sample was development processed in the same manner as above, and latent image storage capability was evaluated. The result was expressed as relative value of sensitivity of the sample preserved at 35° C., 60% RH to the control sample preserved in a freezer. The results obtained are shown in Table 4 below.

Each of Sample Nos. 301 to 308 was exposed and processed according to the following processing step and subjected to sensitometry and gradation was obtained from the gradient of the straight line joining the points of D=0.2 and D=1.0 on the characteristic curve. The results obtained are shown in Table 4 below.

| Processing Step | | |
|---|---|---|
| Processing Step | Processing Time (min) | Processing Temperature (° C.) |
| First Development | 4 | 38 |
| Washing | 2 | 38 |
| Reversal | 2 | 38 |
| Color Development | 6 | 38 |
| Pre-bleaching | 2 | 38 |
| Bleaching | 6 | 38 |
| Fixing | 4 | 38 |
| Washing | 4 | 38 |
| Final Rinsing | 1 | 25 |

The composition of each processing solution is the same as in Example 2.

Two sets of Sample Nos. 301 to 308 were prepared and after each sample was exposed through a wedge filter for 1/100 seconds, development processed according to the above processing step and development progressing capability was evaluated, provided that the processing time of the first development of one set of samples was 2 minutes and the other was 8 minutes, and the capability was expressed by logarithm of the ratio of the reciprocals of exposure amount giving density 0.5 of both samples. The results obtained are shown in Table 4 below.

TABLE 4

| Sample No. | Emulsion No. | Sensitivity | Graininess | Pressure Resistance Before Exposure | Pressure Resistance After Exposure | Development Progressing Capability | Gradation | Latent Image Storage Capability |
|---|---|---|---|---|---|---|---|---|
| 301 (Comparison) | 1' | 100 | 100 | −4 | 6 | 0.41 | 0.97 | 0.92 |
| 302 (Comparison) | 2' | 96 | 98 | −4 | 9 | 0.48 | 0.87 | 0.87 |
| 303 (Invention) | 3' | 125 | 101 | −1 | 2 | 0.24 | 1.22 | 0.99 |

TABLE 4-continued

| Sample No. | Emulsion No. | Sensitivity | Graininess | Pressure Resistance Before Exposure | Pressure Resistance After Exposure | Development Progressing Capability | Development Gradation | Latent Image Storage Capability |
|---|---|---|---|---|---|---|---|---|
| 304 (Invention) | 4' | 119 | 105 | −7 | 9 | 0.45 | 0.91 | 0.91 |
| 305 (Comparison) | 5' | 121 | 104 | −6 | 3 | 0.38 | 0.98 | 0.93 |
| 306 (Comparison) | 6' | 87 | 117 | −10 | 10 | 0.56 | 0.85 | 0.86 |
| 307 (Invention) | 7' | 123 | 100 | −2 | 1 | 0.26 | 1.26 | 0.99 |
| 308 (Invention) | 8' | 122 | 103 | −3 | 3 | 0.31 | 1.15 | 0.96 |

From the results in Table 4, the emulsion according to the present invention which is prepared using the gelatin in which —$NH_2$ groups are chemically modified, which is monodisperse, and which is narrow in the distribution of silver iodide content among grains shows high sensitivity, high contrast gradation, excellent pressure resistance, excellent latent image storage capability and rapid development progress capability.

Specifically, in comparison of Sample Nos. 301 to 304, Sample No. 304 containing Emulsion No. 4' which was grain formed in the presence of gelatin in which —$NH_2$ groups were chemically modified was improved in sensitivity and graininess but pressure resistance and latent image storage capability and gradation of the sample were sufficient, as compared with Sample No. 302 containing Emulsion No. 2' which was not grain formed in the presence of gelatin in which —$NH_2$ groups were chemically modified. It is apparent that these capabilities were improved for the first time in Sample No. 303 containing Emulsion No. 3' according to the present invention having narrow distribution of iodide content among grains.

Further, these capabilities were not improved in Sample No. 301 containing Emulsion No. 1' which did not use gelatin in which —$NH_2$ groups were chemically modified even when distribution of iodide content among grains was narrow. These capabilities are improved for the first time when grain formation is conducted in the presence of gelatin in which —$NH_2$ groups are chemically modified as in the present invention and the emulsion has narrow distribution of iodide among grains.

Further, it can be understood that Sample No. 305 containing Emulsion No. 5' using oxidation-processed gelatin of a low methionine content was interior to Sample No. 303 according to the present invention in pressure resistance and latent image storage capability.

EXAMPLE 4

1) Support

The support which was used in the present invention was prepared as follows.

100 weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermally fixed for 6 seconds at 250° C. and the PEN film having the thickness of 90 μm was obtained. Appropriate amounts of blue dyes, magenta dyes and yellow dyes (I-1, I-4, I-6, I-24, I-26, I-27 and II-5 disclosed in Kokai-Giho, Kogi No. 94-6023) were added to this PEN film. Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 ml/$m^2$, using a bar coater): 0.1 g/$m^2$ of gelatin, 0.01 g/$m^2$ of sodium α-sulfo-di-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/m of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of Backing Layer

On one side of the above support after undercoat layer coating, an antistatic layer, a magnetic recording layer and a sliding layer having the following compositions were coated as backing layers.

3-1) Coating of Antistatic Layer 0.2 g/$m^2$ of a dispersion of fine grain powder of a stannic oxide-antimony oxide composite having the average grain size of 0.005 μm and specific resistance of 5Ω·cm (the grain size of the second agglomerate: about 0.08 μm), 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree: 10) and 0.22 g/$m^2$ of resorcin were coated.

3-2) Coating of Magnetic Recording Layer 0.06 g/$m^2$ of cobalt-y-iron oxide (specific surface area: 43 m 2/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide) which was coating-treated with 3-polyoxyethylene-propyloxytrimethoxysilane (polymerization degree: 15) (15 wt %) , 1.2 g/$m^2$ of diacetyl cellulose (dispersion of the iron oxide was carried out using an open kneader and a sand mill) and 0.3 g/$m^2$ of $C_2H_5C[CH_2CONH{-}C_6H_3(CH_3)NCO]_3$ as a curing agent, with acetone, methyl ethyl ketone and cyclohexanone as solvents, were coated with a bar coater to obtain a magnetic recording layer having the film thickness of 1.2 μm. As a matting agents, 10 mg/$m^2$ of silica grains (0.3 μm) and 10 mg/$m^2$ of an aluminum oxide abrasive (0.15 μm) coating-treated with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The increase of the color density of D of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of Sliding Layer

A mixture of diacetyl cellulose (25 mg/m$^2$), $C_6H_{13}CH(OH)C_{10}OH_{20}COOC_{40}H_{81}$ (Compound a, 6 mg/m$^2$)/$C_{50}H_{101}O(CH_2CH_2O)_{16}H$ (Compound b, 9 mg/m$^2$) mixture was coated. This mixture was dissolved in xylene/propylene monomethyl ether (1/1) by heating at 105° C., and the solution was poured into propylene monomethyl ether (10 time amount) at room temperature and dispersed, and the dispersion was further dispersed in acetone (average grain size: 0.01 μm) and then added to the coating solution. As a matting agents, 15 mg/M$^2$ of silica grains (0.3 μm) and 15 mg/m$^2$ of an aluminum oxide abrasive (0.15 μm) coating-treated with 3-polyoxyethylene-propyloxytrimethoxysilane (polymerization degree: 15) abrasive (15 wt %) were added. Drying was conducted at 115° C. for 6 minutes (the temperature of the roller and transporting device of the drying zone was 115° C.). The thus-obtained sliding layer showed excellent characteristics of dynamic friction coefficient of 0.06 (a stainless steel hard ball of 5 mmφ, load: 100 g, speed: 6 cm/min), static friction coefficient of 0.07 (a clip method), and dynamic friction coefficient of 0.12 between the surface of the emulsion described below and the sliding layer.

Sample Nos. 401 to 417 were prepared in the same manner as for Sample Nos. 201 to 217 in Example 2 except for replacing the support with the above support. The results of evaluation were the same as in Example 2.

EXAMPLE 5

The emulsions of high sensitivity green-sensitive layer and high sensitivity blue-sensitive layer of Photographic Material 1 in Example 1 of JP-A-2-93641 were replaced in the same manner as in Example 2 in the equivalent amount of silver, processed in the same manner as in Example 1 of JP-A-2-93641 and same evaluation as in Example 2 was conducted. The same results as in Example 2 were obtained.

EXAMPLE 6

The emulsions of eighth layer and the eleventh layer of Sample No. 401 in Example 4 of JP-A-6-208181 were replaced as in Example 2 and same evaluation as in Example 2 was conducted. The same results-as in Example 2 were obtained.

While the invention has been described in detail and with reference to specific examples thereof, it will be apparent to one skilled in the art that various changes and modifications can be made therein without departing from the spirit and scope thereof.

What is claimed is:

1. A method for producing a silver halide emulsion in which grains having an aspect ratio of from 1.5 to 100 occupy from 75 to 100% of the total projected area of all grains comprising at least nucleation, ripening and grain growth processes in a dispersion medium solution containing water and a dispersion medium, wherein the dispersion medium solution contains low molecular weight gelatin having a molecular weight of from 1,000 to 70,000 at least during a nucleation process and chemically modified gelatin having a chemical modification rate of an amino group of from 15% to 100% at least during a grain growth process, wherein silver halide grains have 10 or more dislocation lines per one grain in proportion of 50% or more of the number of all the grains in said emulsion.

2. The method for producing a silver halide emulsion as claimed in claim 1, wherein the low molecular weight gelatin contained in said dispersion medium is chemically modified gelatin having a modification rate of an amino group of from 15% to 100%.

3. The method for producing a silver halide emulsion as claimed in claim 1, wherein tabular grains having an aspect ratio of from 2 to 50 occupy 75% or more of the total projected area of all the grains in the emulsion.

4. The method for producing a silver halide emulsion as claimed in claim 1, wherein a variation coefficient of grain size distribution of all the grains in said emulsion is 20% or less.

5. The method for producing a silver halide emulsion as claimed in claim 1, wherein a variation coefficient of distribution among grains of silver iodide content of all the grains in said emulsion is 30% or less.

6. A photographic material which comprises a support having provided thereon at least one light-sensitive silver halide emulsion layer, wherein said photographic material comprises a silver halide emulsion in which grains having an aspect ratio of from 1.5 to 100 occupy from 75 to 100% of the total projected area of all grains, and which silver halide emulsion in produced by a method comprising at least nucleation, ripening and grain growth processes in a dispersion medium solution containing water and a dispersion medium, wherein said dispersion medium solution contains low molecular weight gelatin having a molecular weight of from 1,000 to 70,000 at least during a nucleation process and chemically modified gelatin having a chemical modification rate of an amino group of from 15% to 100% at least during a grain growth process, wherein silver halide grains have 10 or more dislocation lines per one grain in proportion of 50% or more of the number of all the grains in said emulsion.

7. The photographic material as claimed in claim 6, wherein the low molecular weight gelatin contained in said dispersion medium is chemically modified gelatin having a modification rate of an amino group of from 15% to 100%.

8. The photographic material as claimed in claim 6, wherein tabular grains having an aspect ratio of from 2 to 50 occupy 75% or more of the total projected area of all the grains in said emulsion.

9. The photographic material as claimed in claim 6, wherein a variation coefficient of grain size distribution of all the grains in said emulsion is 20% or less.

10. The photographic material as claimed in claim 6, wherein a variation coefficient of distribution among grains of a silver iodide content of all the grains in said emulsion is 30% or less.

11. A silver halide emulsion which contains at least a dispersion medium and silver halide grains, wherein tabular grains having an aspect ratio of from 2 to 50 occupy 75% or more of the total projected area of all the grains, a variation coefficient of grain size distribution of all the grains is 30% or less, silver halide grains have 10 or more dislocation lines per one grain in proportion of 50% or more of the number of all the grains, and from 30 to 100 wt % of said dispersion medium are chemically modified gelatin having a chemical modification rate of an amino group of from 15% to 100%.

12. The silver halide emulsion according claim 11, wherein said silver halide grains have 10 or more dislocation lines per one grain in the proportion of 80% or more of the number of all the grains.

13. The silver halide emulsion according to claim 12, wherein said silver halide grains have 20 or more dislocation lines per one grain in the proportion of 80% or more of the number of all the grains.

14. A photographic material which comprises a support having provided thereon at least one light-sensitive silver halide emulsion layer, wherein said photographic material comprises a silver halide emulsion which contains at least a dispersion medium and silver halide grains, wherein tabular grains having an aspect ratio of from 2 to 50 occupy 75% or more of the total projected area of all the grains, a variation coefficient of grain size distribution of all the grains is 30% or less, silver halide grains have 10 or more dislocation lines per one grain in a proportion of 50% or more of the number of all the grains, and from 30 to 100 wt % of said dispersion medium are chemically modified gelatin having a chemical modification rate of an amino group of from 15% to 100%.

15. The material according claim 14, wherein said silver halide grains have 10 or more dislocation lines per one grain in the proportion of 80% or more of the number of all the grains.

16. The material according to claim 15, wherein said silver halide grains have 20 or more dislocation lines per one grain in the proportion of 80% or more of the number of all the grains.

17. The method for producing a silver halide emulsion according to claim 1, wherein the low molecular weight gelatin has a molecular weight of from 3,000 to 40,000.

18. The photographic material according to claim 6, wherein the low molecular weight gelatin has a molecular weight of from 3,000 to 40,000.

* * * * *